US012669041B2

(12) United States Patent
Rimmer

(10) Patent No.: US 12,669,041 B2
(45) Date of Patent: Jun. 30, 2026

(54) ELECTRIC SUBMERSIBLE PUMP ROTOR ASSEMBLY WITH HYDRODYNAMIC BEARING

(71) Applicant: Halliburton Energy Services, Inc., Houston, TX (US)

(72) Inventor: Michael Rimmer, Frimley (GB)

(73) Assignee: Halliburton Energy Services, Inc., Houston, TX (US)

( * ) Notice: Subject to any disclaimer, the term of this patent is extended or adjusted under 35 U.S.C. 154(b) by 122 days.

(21) Appl. No.: 18/644,477

(22) Filed: Apr. 24, 2024

(65) Prior Publication Data

US 2025/0334031 A1 Oct. 30, 2025

(51) Int. Cl.
*E21B 43/12* (2006.01)
*F04D 13/10* (2006.01)
(Continued)

(52) U.S. Cl.
CPC ..... *E21B 43/128* (2013.01); *F04D 13/10* (2013.01); *F04D 25/062* (2013.01);
(Continued)

(58) Field of Classification Search
CPC .... F04D 13/10; F04D 29/0413; F04D 29/047; F04D 29/0473; F04D 29/046; F04D 1/04;
(Continued)

(56) References Cited

U.S. PATENT DOCUMENTS 7,575,413 B2 * 8/2009 Semple ..... F04D 13/10 384/275
8,220,999 B2 7/2012 Cooley et al.
(Continued)

FOREIGN PATENT DOCUMENTS

EP 2914859 B1 2/2021
JP 2012219866 A 11/2012
WO WO-2022212660 A1 * 10/2022 ..... F04D 29/046

OTHER PUBLICATIONS

Foreign Communication from Related Application—International Search Report and Written Opinion of the International Searching Authority, International Application No. PCT/US2024/031237, dated Jan. 16, 2024, 11 pages.
(Continued)

*Primary Examiner* — Dominick L Plakkoottam
(74) *Attorney, Agent, or Firm* — Conley Rose, P.C.; Rodney B. Carroll

(57) ABSTRACT

An exemplary rotor assembly for an electric submersible pump may include a drive shaft, a journal sleeve concentrically disposed about and rotationally fixed to the drive shaft, a bushing concentrically disposed about and configured to rotate with respect to the journal sleeve, and a thrust washer, or component integrating the thrust washer, encircling the drive shaft. Concavities may be formed in an axial face of the bushing or an axial face of the thrust washer. The axial face of the bushing may be disposed proximate to the axial face of the thrust washer. The concavities may be configured to influence flow of lubrication fluid between the bushing and the thrust washer to create a hydrodynamic force against the bushing and the thrust washer when the drive shaft rotates to prevent axial contact.

23 Claims, 19 Drawing Sheets

(51) Int. Cl.

| | |
|---|---|
| ***F04D 25/06*** | (2006.01) |
| ***F04D 29/041*** | (2006.01) |
| ***F04D 29/046*** | (2006.01) |
| ***F04D 29/047*** | (2006.01) |

(52) U.S. Cl.
CPC ..... *F04D 29/0413* (2013.01); *F04D 29/046* (2013.01); *F04D 29/047* (2013.01)

(58) Field of Classification Search
CPC .. F04D 29/041; F04D 29/0462; F04D 25/062; F04D 29/061; F04D 29/22; E21B 43/128
See application file for complete search history.

(56) References Cited

U.S. PATENT DOCUMENTS

| | | | | |
|---|---|---|---|---|
| 9,353,752 | B2 * | 5/2016 | Tetzlaff | F04D 13/10 |
| 11,920,599 | B2 * | 3/2024 | Ekambaram | F04D 29/0473 |
| 2002/0125777 | A1 * | 9/2002 | Parmeter | H02K 5/1672 310/90 |
| 2006/0204359 | A1 | 9/2006 | Semple et al. | |
| 2010/0098564 | A1 * | 4/2010 | Parmeter | F04D 13/10 417/423.3 |
| 2013/0330211 | A1 | 12/2013 | Morrow | |
| 2014/0127052 | A1 * | 5/2014 | Knapp | H02K 5/1677 417/410.1 |
| 2015/0023815 | A1 | 1/2015 | Tetzlaff et al. | |
| 2015/0188384 | A1 * | 7/2015 | Rumbaugh | H02K 5/167 310/90 |
| 2016/0053807 | A1 * | 2/2016 | Maciver | F16C 27/02 384/473 |
| 2017/0058616 | A1 * | 3/2017 | Lunk | E21B 43/128 |
| 2022/0282732 | A1 | 9/2022 | Ekambaram et al. | |
| 2024/0175465 | A1 * | 5/2024 | Ekambaram | F04D 13/10 |
| 2024/0405648 | A1 | 12/2024 | Beneze et al. | |

OTHER PUBLICATIONS

Filing Receipt, Specification and Drawings for U.S. Appl. No. 18/663,92, entitled, "Electric Submersible Pump Rotor Assembly With Bearing Spacer Configured for Thrust Washer Support," filed Jun. 23, 2025, 85 pages.

Foreign Communication from Related Application—International Search Report and Written Opinion of the International Searching Authority, International Application No. PCT/US2025/038823, dated Mar. 12, 2026, 10 pages.

* cited by examiner

ELECTRIC SUBMERSIBLE PUMP ROTOR ASSEMBLY WITH HYDRODYNAMIC BEARING

CROSS-REFERENCE TO RELATED APPLICATIONS

None.

STATEMENT REGARDING FEDERALLY SPONSORED RESEARCH OR DEVELOPMENT

Not applicable.

FIELD

This disclosure relates generally to the field of pumping. More particularly, this disclosure relates to the field of electric submersible pumps for use downhole in a well. Still more particularly, this disclosure relates to an electric submersible pump rotor assembly with a hydrodynamic bearing.

BACKGROUND

Electric submersible pump (ESP) assemblies may be used to artificially lift fluid to the surface, for example in deep wells such as oil or water wells. ESP assemblies are commonly used in the oil and gas industry to extract fluids from underground reservoirs. By way of example, the artificial lift provided by ESP assemblies may be useful in situations when the reservoir does not have sufficient energy to allow the well to naturally produce effectively, or when an additional boost to production of the well is desired.

ESPs with certain types of motors (for example, permanent magnet motors) can exert a considerable load on the bearing due to the magnetic attraction to the stator. This can magnify the bearing load by two to ten times the gravitational load from the rotor mass. This force can create a large axially disposed frictional sliding force in the axial direction. A reaction load must be applied above this sliding force in order to move the bearing axially. In other words, the thrust capacity of the end of the bearing needs to be higher than the reaction load. In vertical operation of the motor, the gravitational weight of the outer bearing sleeve may bear down onto the thrust washer face. In other words, the outer bearing sleeve typically should have enough capacity to support this weight. In all orientations of the motor, the components may thermally expand to different degrees. This can lead to situations (due to the long lengths of the downhole motors) where the stationary outer bearing sleeve comes into axial contact with the rotor axial face due to the different relative rotor thermal growths. If the rotor thermal growth is larger than the axial gaps, high loads will be generated in the case in which outer bearing sleeve does not move. This load may climb until the applied "thermal growth" reaction force exceeds the sliding force.

The axial face of the conventional bearing may have insufficient load capacity to carry such loads and contact may occur between the rotating rotor face and the static bearing face. A thrust washer of the bearing may start to wear. Additionally, contact can generate heat that can cause the material to indent as its strength becomes too weak to resist the applied force. As the failure progresses, the static sleeve may dig into the rotating washer, which may eventually cause the thrust washer to fail. The digging in also may also lead to increased radial load on the bearing, which can ultimately lead to a radial bearing failure. The eventual consequence of the bearing failures may be motor failure and ultimate failure of the ESP.

Disclosed embodiments may provide for an improved bearing for an ESP that may address one or more of the above-mentioned issues.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "upstream," "downstream," "up," and "down" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" is directed counter to the direction of flow of well fluid, towards the source of well fluid. "Up" is directed in the direction of flow of well fluid, away from the source of well fluid.

Disclosed embodiments relate generally to rotor assemblies for an ESP motor (e.g. for use with a pump to form an ESP assembly for use downhole in a well to pump formation fluids from the well formation to the surface), with the rotor assemblies being configured to address differential thermal expansion and the related issues arising therefrom.

Figure 1:
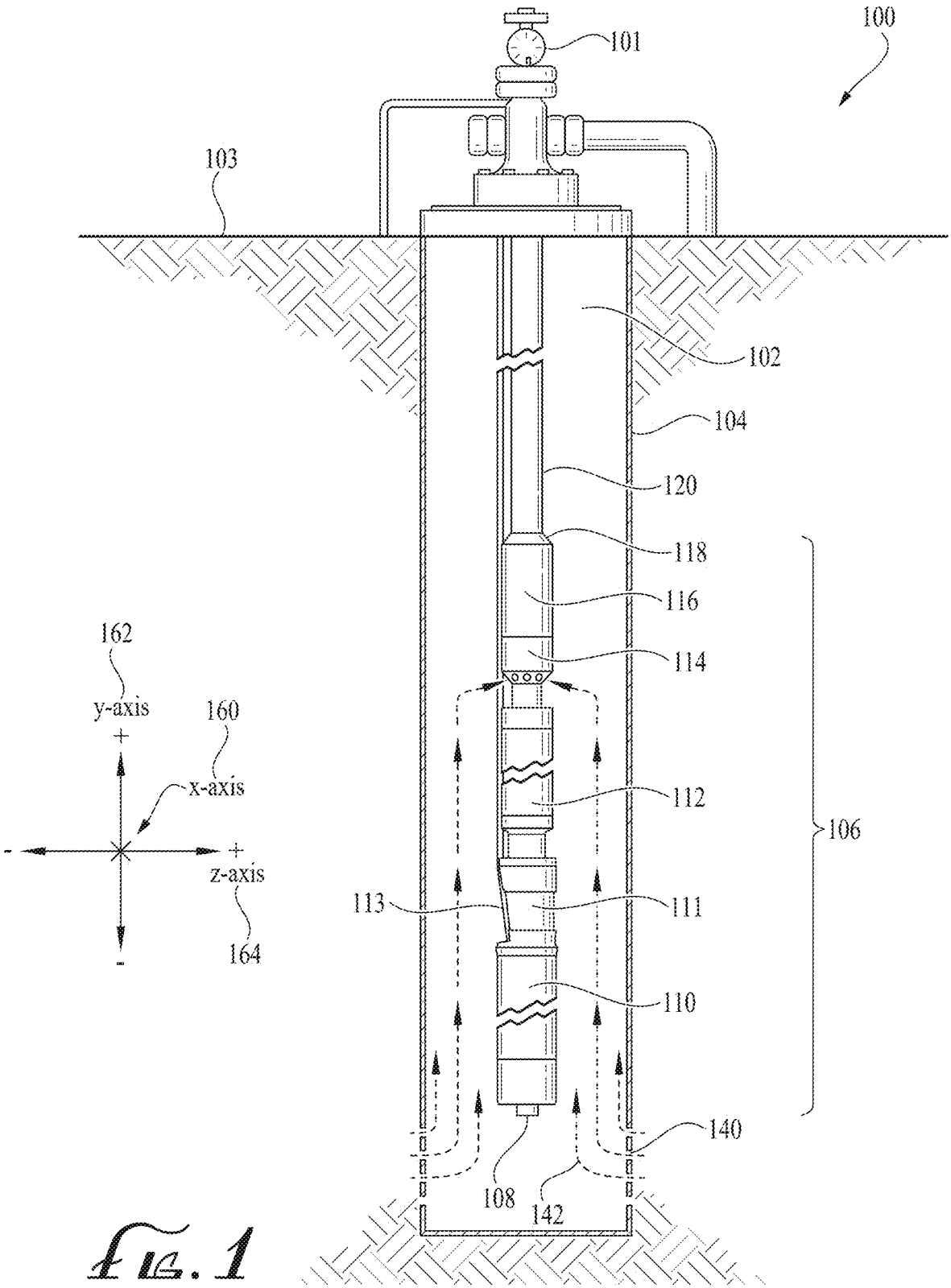
FIG. 1 is a schematic illustration of an exemplary electric submersible pump (ESP) assembly disposed in a wellbore, according to an embodiment of the disclosure.

Turning now to FIG. 1, an exemplary producing well environment 100 is described. In an embodiment, the environment 100 comprises a wellhead 101 above a wellbore 102 located at the surface 103. A casing 104 is provided within the wellbore 102. For convenience of reference, FIG. 1 provides a directional reference comprising three coordinate axes—an X-axis 160 where positive displacements along the X-axis 160 are directed into the sheet and negative displacements along the X-axis 160 are directed out of the sheet; a Y-axis 162 where positive displacements along the Y-axis 162 are directed upwards on the sheet and negative displacements along the Y-axis 162 are directed downwards on the sheet; and a Z-axis 164 where positive displacements along the Z-axis 164 are directed rightwards on the sheet and negative displacements along the Z-axis 164 are directed leftwards on the sheet. In the embodiment of FIG. 1, the Y-axis 162 is approximately parallel to a central axis of a vertical portion of the wellbore 102.

An exemplary electric submersible pump (ESP) assembly 106 may be deployed downhole in a well within the casing 104 and may comprise an optional sensor unit 108, an electric motor 110 which may include a motor head 111, a seal unit 112, an electric power cable 113, a pump intake 114, a centrifugal pump 116, and a pump outlet 118 that couples the centrifugal pump 116 to a production tubing 120. The centrifugal pump 116 may be operatively coupled to the motor 110 by a shaft. In an embodiment, the ESP assembly 106 may employ thrust bearings in several places, for example in the electric motor 110, in the seal unit 112, and/or in the centrifugal pump 116. In an embodiment, the ESP assembly 106 can comprise a gas separator that may employ one or more thrust bearings. The motor head 111 may couple the electric motor 110 to the seal unit 112. The electric power cable 113 may connect to a source of electric power at the surface 103 and to the electric motor 110, for example being configured to provide power from the source of electric power at the surface 103 to the electric motor 110.

In operation, the casing 104 is pierced by perforations 140, and reservoir fluid 142 flows through the perforations 140 into the wellbore 102. The fluid 142 flows downstream in an annulus formed between the casing 104 and the ESP assembly 106, is drawn into the pump intake 114, is pumped by the centrifugal pump 116, and is lifted through the production tubing 120 to the wellhead 101 to be produced at the surface 103. The fluid 142 may comprise hydrocarbons such as oil and/or gas, water, or both hydrocarbons and water.

While the example illustrated in FIG. 1 relates to land-based subterranean wells, similar ESP systems can be used in a subsea environment and/or may be used in subterranean environments located on offshore platforms, drill ships, semi-submersibles, drilling barges, etc. And while the wellbore is shown in FIG. 1 as being approximately vertical, in other embodiments, the wellbore may be horizontal, deviated, or any other type of well. Also, while the pump of the ESP is described with respect to FIG. 1 as a centrifugal pump, other types of pumps (such as a rod pump, a progressive cavity pump, any other type of pump suitable for the system, or combinations thereof) may be used instead.

Figure 2:
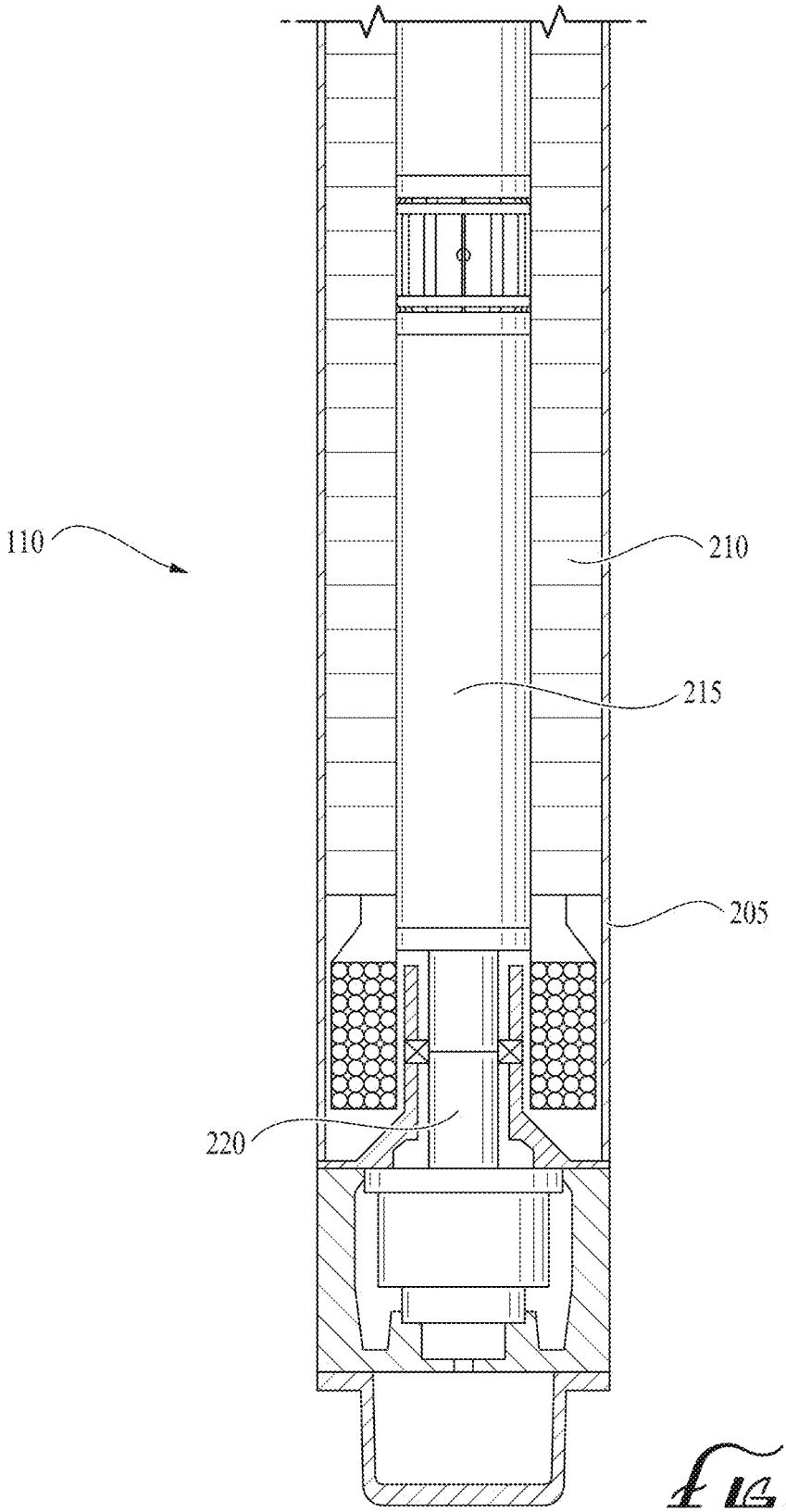
FIG. 2 is a cross-sectional view of an exemplary motor for the electric submersible pump assembly of FIG. 1, according to an embodiment.
Figure 3:
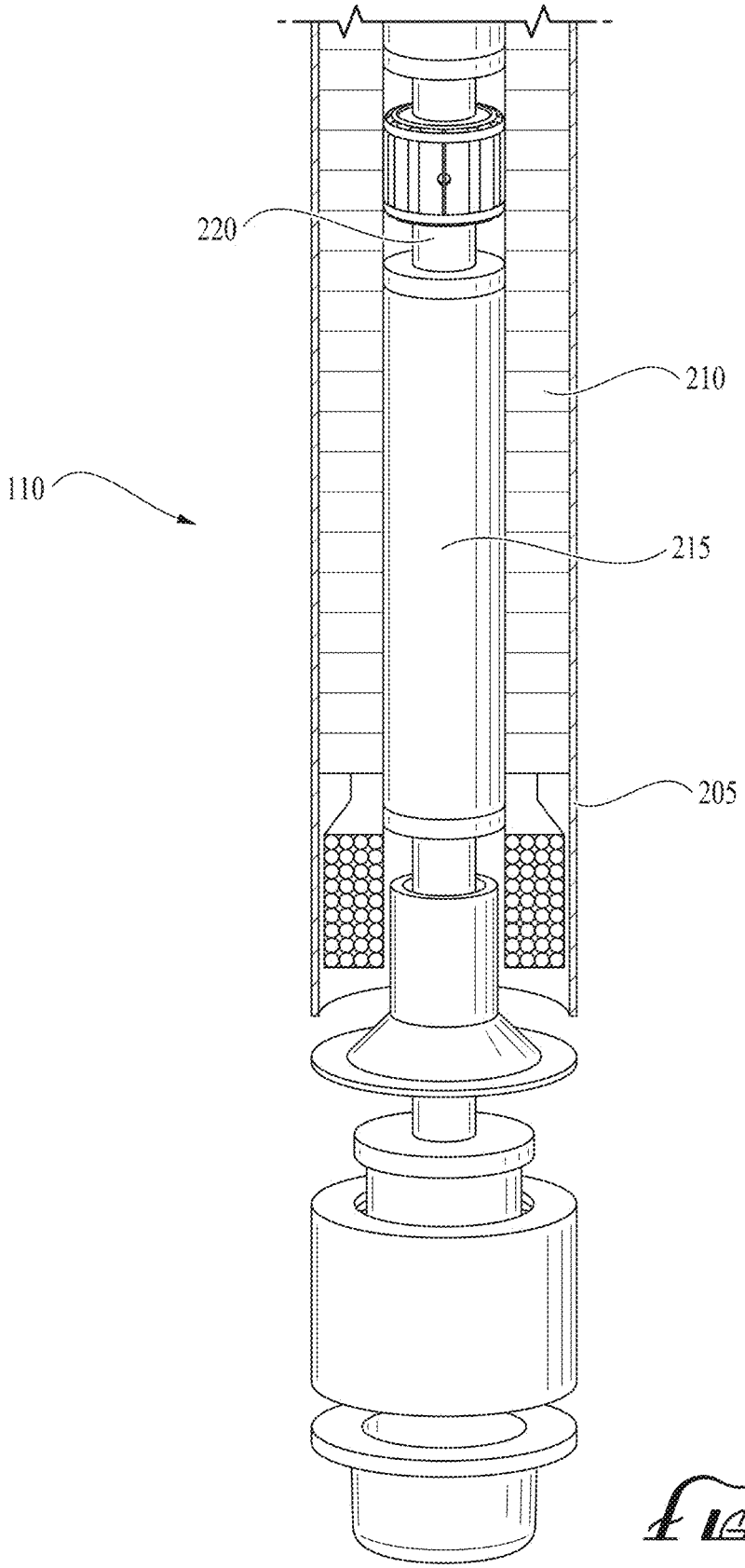
FIG. 3 is an exploded isometric view of the motor of FIG. 2, according to an embodiment of the disclosure.

As shown in FIGS. 2-3, an exemplary motor 110 of the ESP assembly includes a housing 205, a stator 210, a rotor 215, and a drive shaft 220. The housing 205 may comprise a hollow cylinder or tube and is configured to protect the internal components of the motor 110 from the external environment. The stator 210 may also comprise a hollow cylinder and is secured to the housing 205 (e.g. to the inner surface of the housing 205) so as to be stationary within the housing 205. The stator 210 may comprise a plurality of laminations, which may be thin sheets of steel, iron, or bronze, wrapped by a plurality of electrically conductive windings. When energized, the windings generate a rotating magnetic field for interaction with the rotor 215 to induce rotation of the rotor 215. The rotor 215 may also comprise a hollow cylinder and is concentrically arranged between the stator 210 and the drive shaft 220, for example with the drive shaft 220 typically extending longitudinally along the centerline of the motor 110, the rotor 215 disposed around the drive shaft 220, and the stator 210 disposed around the rotor 215, within the housing 205. The rotor 215 may be rotatable within the stator 210 and secured to the drive shaft 220, such that rotation of the rotor 215 drives the drive shaft 220. In embodiments, the motor 110 may be a two or more pole motor, a three-phase squirrel cage induction motor, a permanent magnet motor (PMM), a hybrid PMM, or other motor configuration.

Figure 4:
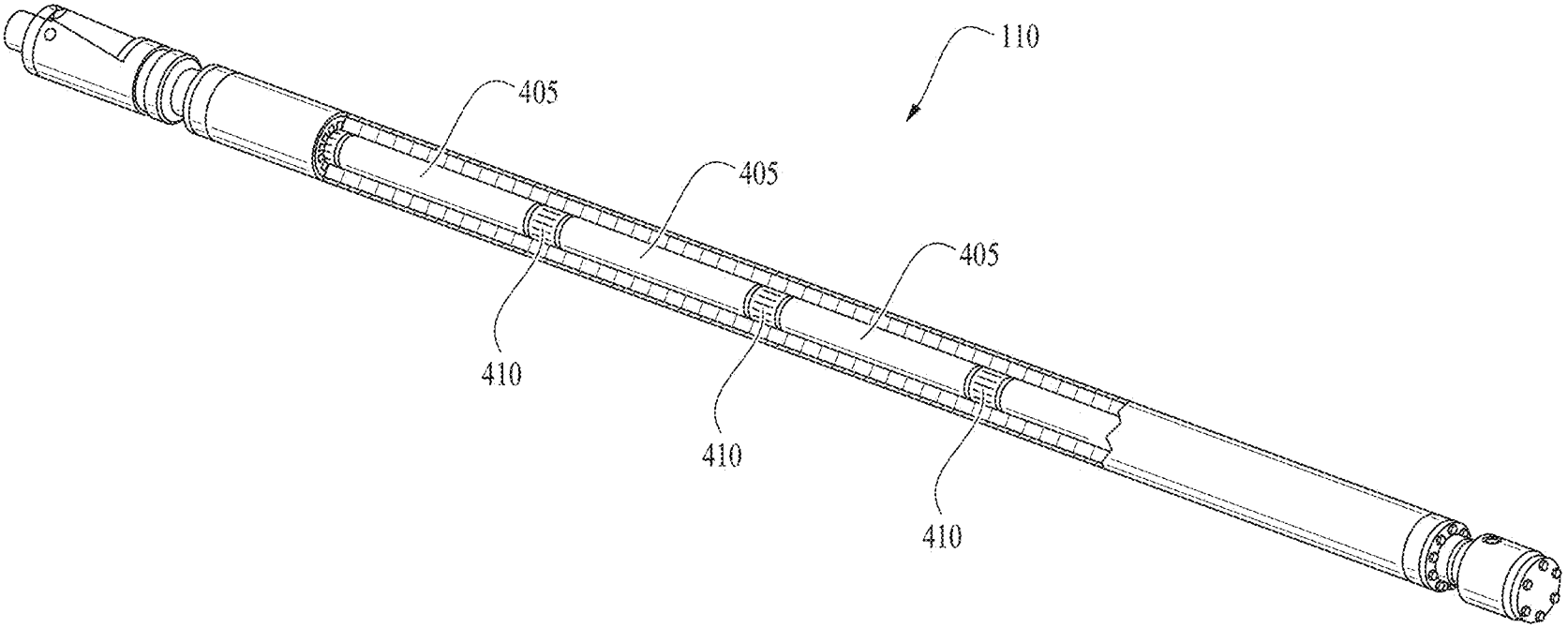
FIG. 4 is a partial cut-away isometric view of an exemplary ESP motor having a plurality of rotor modules with rotor assemblies therebetween, according to an embodiment of the disclosure.

Depending on the power requirements of the motor 110, the rotor 215 can be an assembly which typically includes a number of rotor modules, which together jointly form the rotor assembly 215, with each rotor module secured to the drive shaft 220. The rotational magnetic field of the stator 210 when energized can induce rotation of the rotor 215, and thereby the drive shaft 220, with the drive shaft 220 transmitting rotational torque from the motor 110 to the pump 116. As shown in FIG. 4, the rotor modules 405 (jointly forming the rotor 215) can be spaced apart from each other along the drive shaft 220, with a rotor bearing assembly 410 located between adjacent rotor modules 405. Rotor bearing assemblies 410 can also be located at the top of the uppermost rotor module 405 and/or the bottom of the lowermost rotor module 405 (e.g. at the top and bottom of the rotor). In some embodiments, the rotor bearing assembly 410 can be a hydrodynamic rotor bearing assembly. Each rotor bearing assembly 410 is configured to support the rotor 215 at predefined axial positions to maintain correct radial alignment of the drive shaft 220 during motor operation.

As discussed in more detail below with respect to specific embodiments, rotor bearing assemblies 410 can comprise a journal sleeve and a bushing assembly. The journal sleeve may be concentrically disposed around and secured to the drive shaft 220 to rotate with the drive shaft 220. In embodiments, the inner journal sleeves can be configured to space each rotor module 405 evenly on the drive shaft 220. The outer bushing assembly may be concentrically located around the inner journal sleeve, and the bushing assembly may fixedly engage into the stator lamination (e.g. the bushing assembly is configured to engage the inner surface of the stator 210 to prevent rotation therein). The engagement into the stator lamination is required to ensure that the bushing assembly does not spin during operation, but instead provides a stationary surface within which the inner journal sleeve can rotate, to produce a hydrodynamic lubricating film.

During start-up and in operation, the rotor 215 may be heated, for example due to friction, and thereby expands radially and axially. Since materials with different coefficient of thermal expansion (CTE) may be used in rotor construction, the components of the rotor 215 (e.g. with different CTE) can expand at different rates. Further, the expansion between the drive shaft 220 and one or more of the components of the rotor 215 can vary.

A snap ring or similar end support structure can be installed at one end of the shaft to support the mass of the rotor assembly 215 components (e.g. with respect to gravity). The mass of each rotor module 405 can be transferred to the next (e.g. lower) rotor module 405 (e.g. through the rotor bearing assemblies 410 disposed between adjacent rotor modules 405). The components of the last (e.g. lowest/bottom) rotor module 405, such as the last thrust washer, may be subjected to the weight of all components above. The strength of this polymeric thrust washer, for example, could be the limiting factor for the number of rotor modules 405 that can be used in a rotor assembly 215.

Another snap ring can be installed at the opposite end of the shaft 220, at a pre-defined distance from the first/upper most rotor module 405 to ensure that there is enough expansion length (e.g. for thermal expansion). In other embodiments a spring loaded mechanism can fill the gap between the snap ring and rotor module 405. The rotor modules 405 can be (axially) loose on the shaft 220, and they can be operable to shift axially during installation into the stator 210 and/or during operation of the motor 110. The stator 210 may require allowance for the rotor 215 thermal growth, to ensure that the rotor end bearings cannot extend out from its support in the stator lamination stack.

Figure 5:
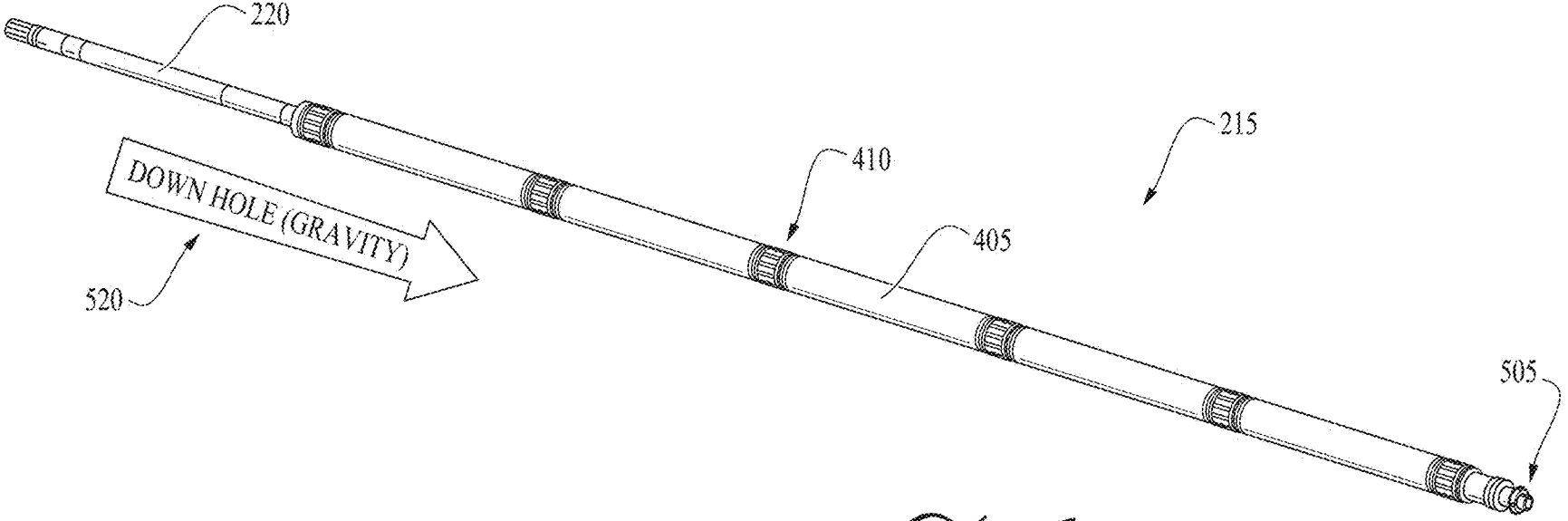
FIG. 5 is an isometric view of an exemplary rotor assembly for an ESP motor of an ESP pump assembly, according to an embodiment of the disclosure.

Turning now to the figures in detail for more specific examples, FIG. 5 illustrates a typical rotor assembly 215 of an electric motor 110 (for example, of an ESP assembly). In embodiments, the electric motor 110 can be a permanent magnet motor. Typically, the rotor assemblies 215 shown in the figures belong to such a permanent magnet motor (PMM). However, alternate embodiments may include an electric motor of any conventional type, i.e. an induction motor or a hybrid PMM containing elements of both permanent magnet and induction motors. The rotor assembly 215 of the PMM utilizes permanent magnets to generate the electromagnetic field, compared to induction motors where the magnetic field is generated by inducing a current in rotor interconnected bars made from copper.

A rotor assembly 215 embodiment can comprise a single drive shaft 220, a plurality of magnetic rotor modules 405, and a plurality of radial hydrodynamic rotor assemblies 410. A rotor assembly 410 can be disposed between adjacent rotor modules 405. In embodiments, the rotor assembly 215 can also include a pre-loading mechanism 505 (as shown in FIG. 5), which can provide thermal expansion compensation for the rotor assembly 215. In the embodiment shown in FIG. 5, the pre-loading mechanism 505 is disposed at the non-drive end (e.g. the motor base) of the rotor assembly 215, and it can be configured to act against the gravitational load 520 created by all the rotor modules 405 and journal rotor assemblies 410 installed on the shaft 220 (as well as addressing differential thermal expansion, for example). Alternatively, or in conjunction, the pre-loading mechanism 505 can be positioned at the drive end (e.g. the motor head) of the shaft 220, according to other embodiments.

Figure 6A:
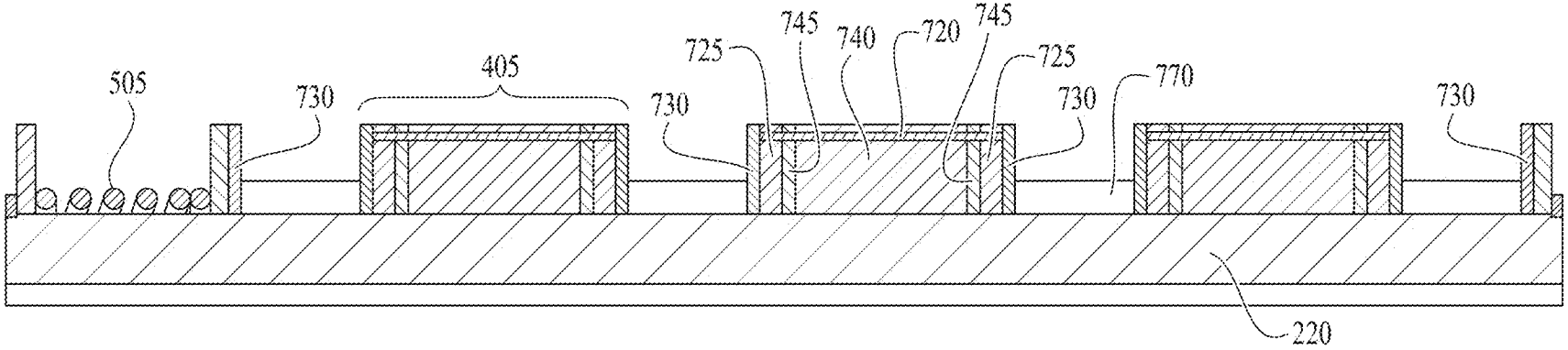
FIG. 6A is schematic axial cross-section view of an exemplary rotor assembly, according to an embodiment of the disclosure.
Figure 6B:
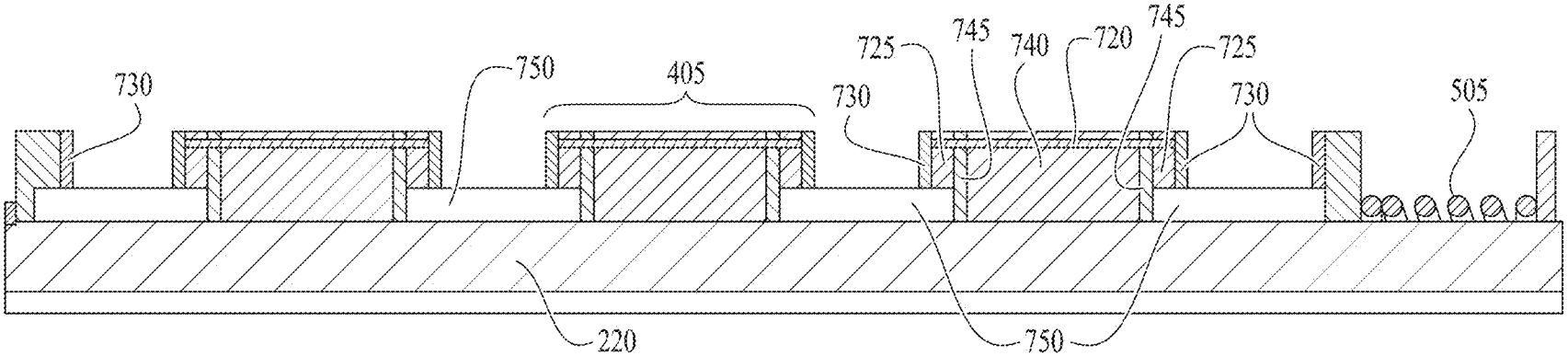
FIG. 6B is a schematic axial cross-section view of another exemplary rotor assembly, according to an embodiment of the disclosure.
Figure 7:
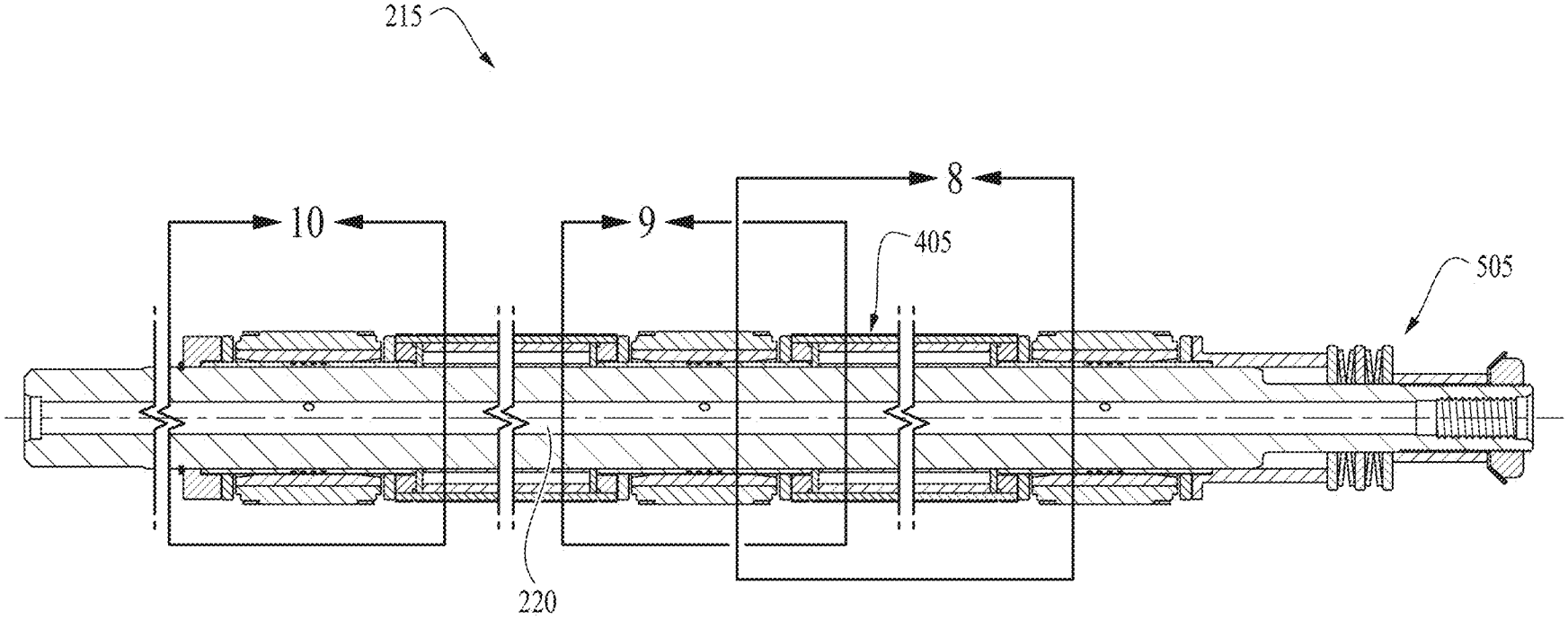
FIG. 7 is an axial cross-section view of yet another exemplary rotor assembly, according to an embodiment of the disclosure.

FIGS. 6A and 6B illustrate schematically alternate stacking embodiment options for components of a rotor assembly 215. In the embodiment of FIG. 6A, a journal sleeve 770 of a rotor assembly 410 is installed between each adjacent pair of rotor modules 405. The journal sleeve 770 may be installed directly onto the drive shaft 220 (e.g. concentric with the drive shaft 220) and may axially contact any adjacent rotor modules 405 (which are also concentrically disposed on the drive shaft 220). This method of stacking the rotor modules 405 and journal sleeves 770 onto the shaft 220 may have all rotor module 405 components compressed between two adjacent journal sleeves 770 located on both sides of the rotor module 405. A thrust washer 730 may be trapped between the bearing and the rotor module.

An alternate stacking method is shown in FIG. 6B. For example, the cage rings 725, rotor bars 720, and the thrust washers 730 can be disconnected from (e.g. moved out of) the axial stack of supporting components of the rotor assembly. Each rotor module 405 (e.g. comprised here with respect to axial force transmission of only the lamination stack 740 and the end laminations 745, both made from steel) can be spaced by a steel support sleeve 750 (as will be discussed in more detail below with respect to specific embodiments). While the support sleeve 750 may be steel in some embodiments, in other embodiments, the support sleeve can be formed of other materials with CTE similar to that of the lamination stack 740, end laminations 745, and/or drive shaft 220. The thrust washers 730 may be connected to the support sleeve 750 to prevent them moving axially as shown in later embodiments.

The thrust washer does not necessarily be a separate component. In some embodiments, the thrust washer is absent, and instead the end face of the rotor module 405, case ring 725, spacer ring 1210, or any other suitable element may have a face that acts as the face of the thrust washer. This end face may have any of the features (e.g., concavities 611, grooves 612, etc.) discussed herein with respect to the thrust washer.

Figure 8:
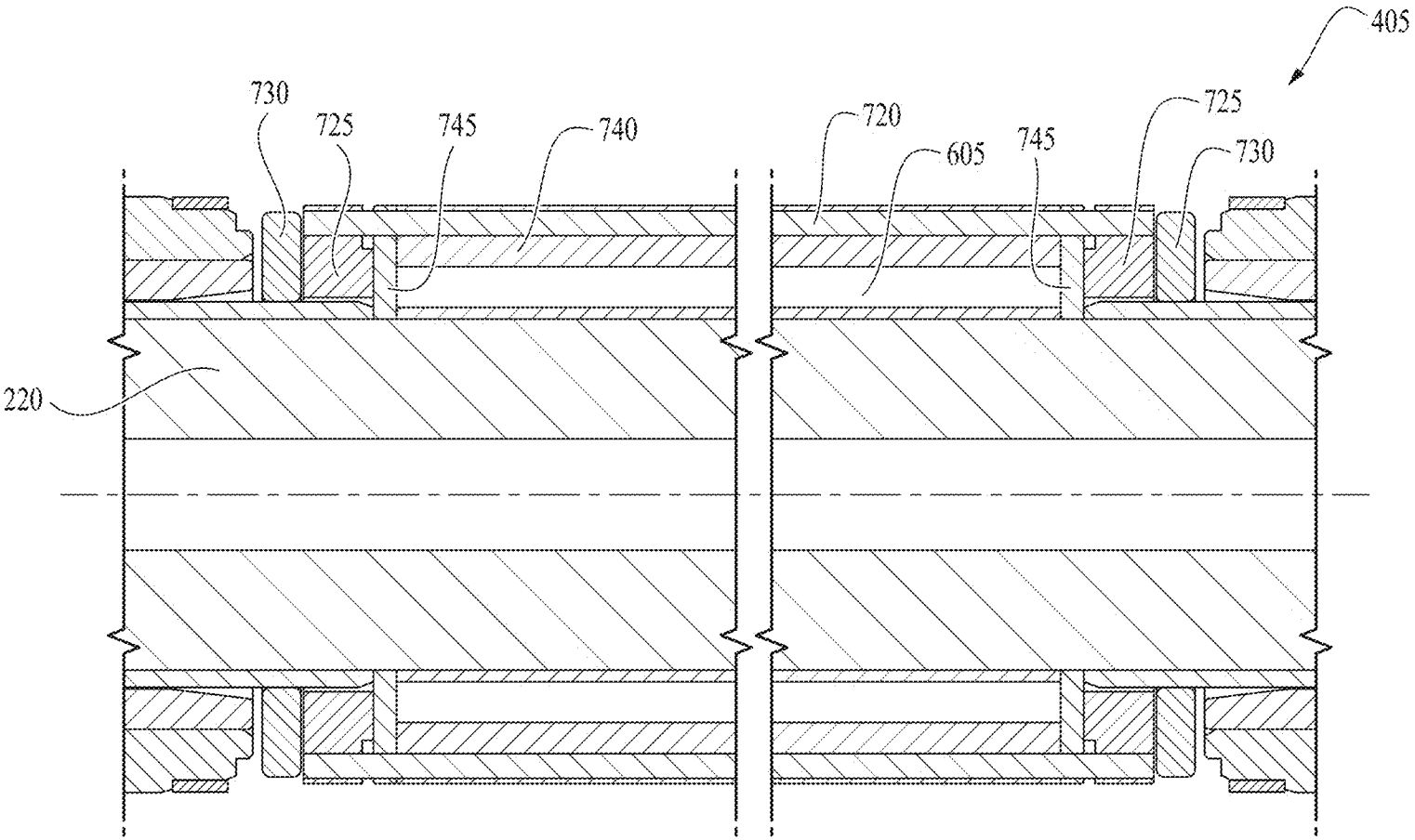
FIG. 8 is an enlarged portion of the axial cross-section view of the rotor assembly of FIG. 7, according to an embodiment of the disclosure.

The magnetic rotor module 405 shown in FIG. 8 may include the lamination stack 740, the end laminations 745, the plurality of cage bars 720, and the plurality of cage rings 725. The lamination stack 740, plurality of cage bars 720 as a whole, and each cage ring 725 may be concentrically disposed about the drive shaft 220. The lamination stack 740 can be made from a plurality of stamped thin sheets of electrical steel, which may be assembled together by bonding, by clinching, or by use of interference fit to another component (e.g. the drive shaft 220). In embodiments, the lamination stack 740 can include the desired geometry (e.g. pockets) to accept a plurality of permanent magnets 605, which may be made from rare earth such as Samarium Cobalt or Neodymium Iron Boron. The end laminations 745 can be disposed on each end of the lamination stack 740, for example to trap the magnets in the lamination stack pockets. The end laminations 745 may be thicker steel than the lamination stack 740. The plurality of electrically conductive (e.g. copper) cage bars 720 can be installed inside a plurality of longitudinally extending holes in the lamination stack 740 (e.g. with the longitudinally extending holes disposed around the drive shaft 220), and may protrude from each end of the lamination stack 740. The electrically conductive (e.g. brass) cage rings 725, can be disposed on each end of the lamination stack 740, for example connected to the plurality of cage bars 720 by interference fit or soldering to create a squirrel cage (e.g. similar to an induction motor). In other embodiments, the permanent magnets 605 can be omitted, making the rotor module 405 a standard induction rotor module.

Figure 9:
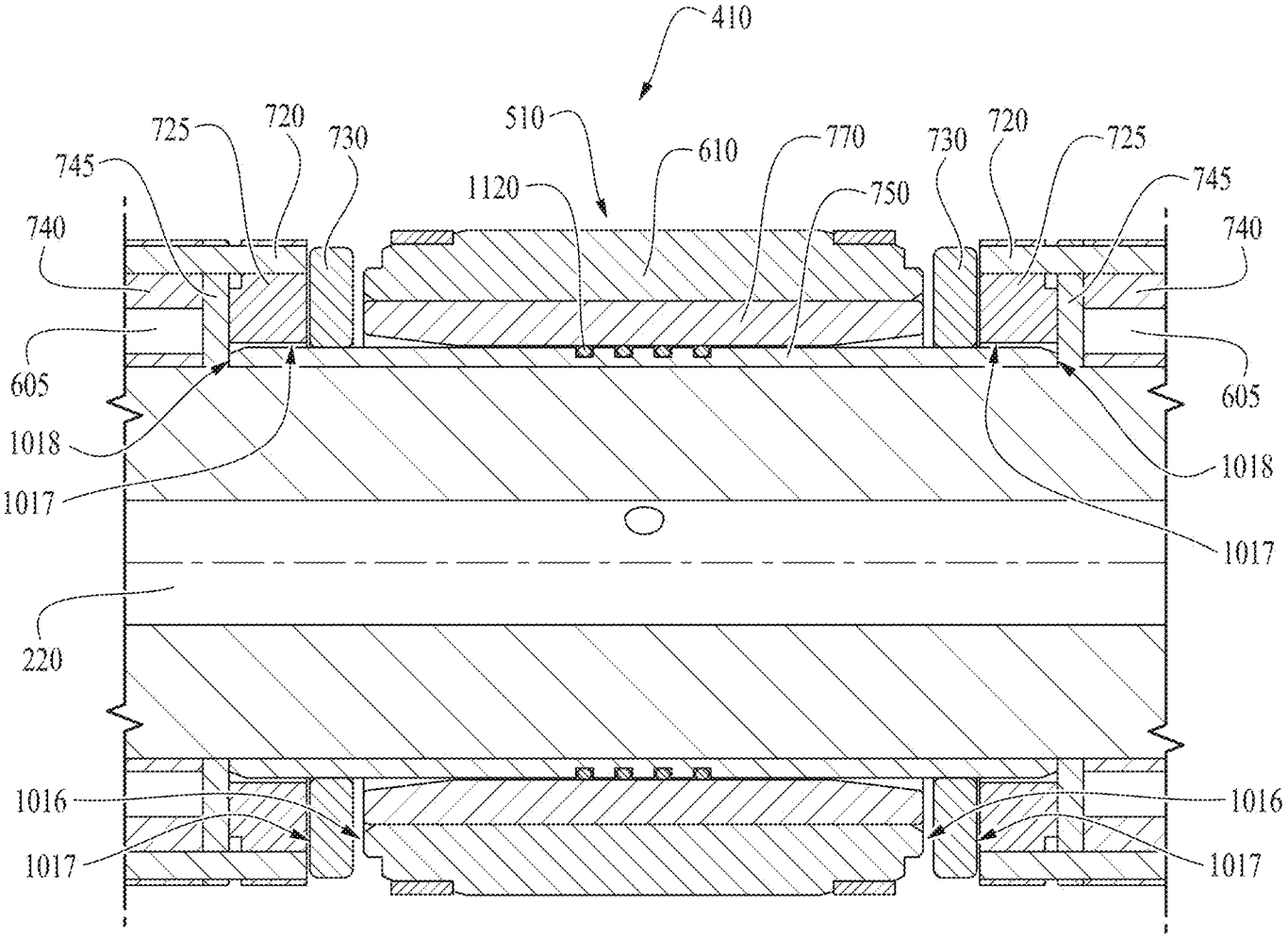
FIG. 9 is an enlarged portion of the axial cross-section view of the rotor assembly of FIG. 7, showing the journal rotor assembly between two adjacent rotor modules, according to an embodiment of the disclosure.

FIG. 9 shows a rotor assembly 410, which may support the rotor at predefined axial positions to maintain radial alignment of the shaft 220 during the motor operation. The rotor assembly 410 can comprise an inner journal sleeve 770 and an outer bushing assembly 510, for example with the bushing 610 configured to be disposed concentrically about the journal sleeve 770. The inner journal sleeve 770 can be secured to the shaft 220 through a support sleeve 750 (which typically may be steel or some other material with CTE similar to the lamination stack 740, the end laminations 745, and/or the drive shaft 220). For example, anti-rotation elements 1120 (e.g. helical springs or elastomeric rings) may rotationally fix the journal sleeve 770 to the support sleeve 750, so that the journal sleeve 770 rotates with the support sleeve 750 (and thereby the shaft 220). The support sleeve 750 may be concentrically disposed about the drive shaft 220 (e.g. between two adjacent rotor modules 405) and can be configured to rotate with the drive shaft 220 while being able to slide axially with respect to the shaft 220. For example, the support sleeve 750 can be keyed to the shaft 220 (e.g. with one or more keys in corresponding longitudinally extending key slots in the shaft) so as to be allowed to slide along the shaft 220 axially while rotating with the shaft 220.

The anti-rotation element's 1120 secondary function can be to axially center the inner journal sleeve 770 between the two adjacent rotor modules 405. The outer bushing assembly 510 may be concentrically located around the journal sleeve 770 and may engage into the stator lamination. The engagement into the stator lamination may ensure that the bushing assembly 510 does not spin during operation. Rather, the bushing assembly 510 can provide a stationary surface for journal sleeve 770 to rotate in, which may allow it to produce hydrodynamic lubricating film. The support sleeve 750 also can space each rotor module 405 evenly on the shaft 220. The support sleeve 750 in FIG. 9 is configured to provide axial support to the lamination stack 740 of adjacent rotor modules 405 through the end laminations 745, for example touching/abutting the adjacent end lamination 745 on both adjacent magnetic rotor modules 405 (e.g. on either side) at the contact surface 1018. The adjacent cage rings 725 of the magnetic rotor modules 405 of FIG. 9 may be concentrically disposed around the steel support sleeve 750, having a radial clearance round the steel support sleeve 750. In this embodiment, the thrust washers 730 can be mounted onto the support sleeve 750, on both ends (e.g. with the rotor assembly 410 disposed therebetween). For example, a thrust washer 730 may be disposed between the rotor assembly 410 and the adjacent rotor module 405. In embodiments, the thrust washers 730 can be mounted on the support sleeve 750 by an interference fit method, although other methods of assembly can be implemented, such as anti-rotation keys/tabs and axial retaining shoulders/spigots. The design of the support sleeve 750 can create defined axial clearances 1016 and 1017 between the thrust washer 730 and the rotor assembly 410 and the cage ring 725 of the magnetic rotor module 405, respectively. Clearance 1016 may allow the thrust washers 730 to not contact the bushing assembly 510 during the motor operation (e.g. when the rotor assembly 215 is rotating inside the stator assembly 210). In other embodiments this gap may close and result in thrust force on the thrust washer 730.

Figure 10:
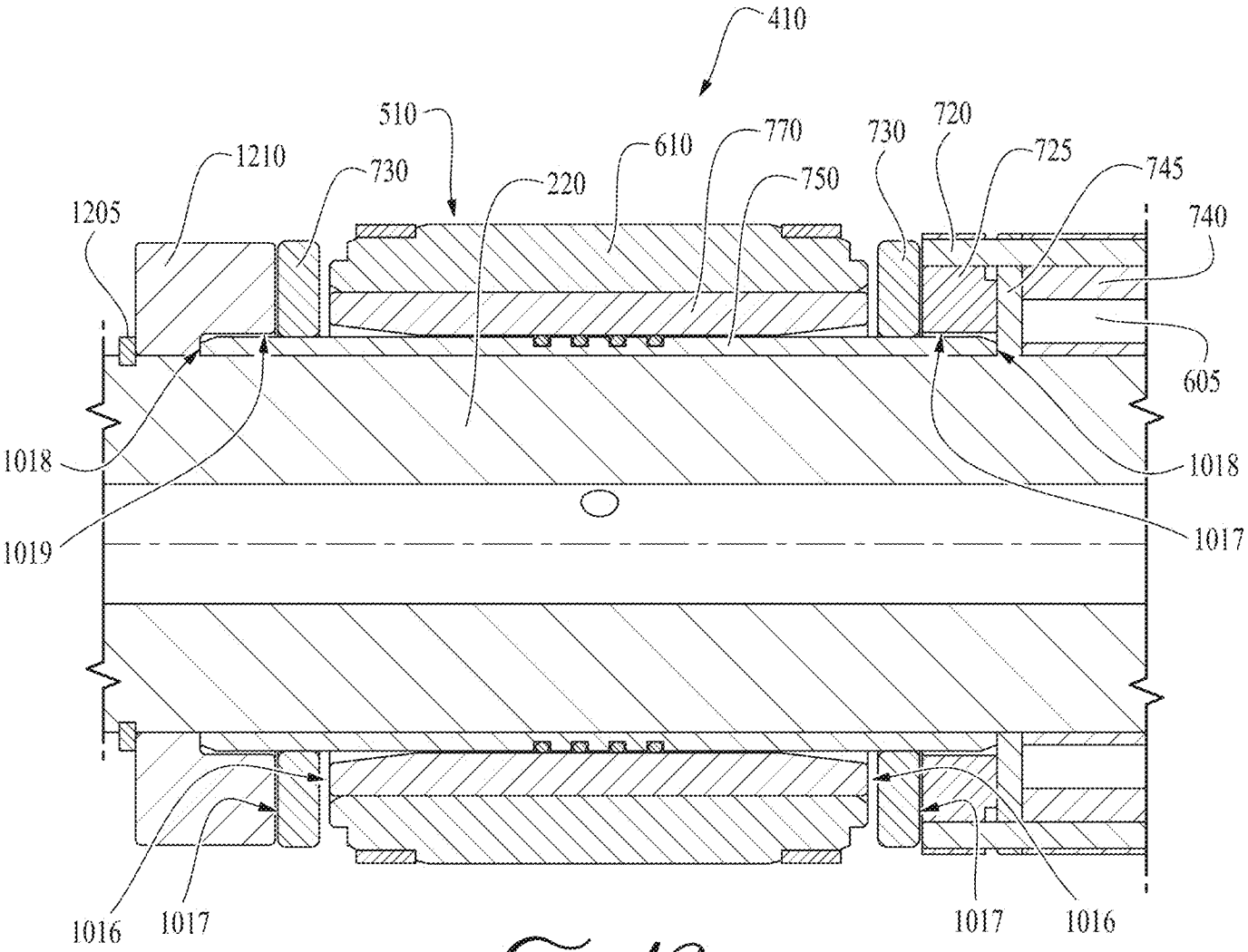
FIG. 10 is an enlarged portion of the axial cross-section view of the rotor assembly of FIG. 7, showing the journal rotor assembly at the motor head end of the shaft, according to an embodiment of the disclosure.
Figure 11:
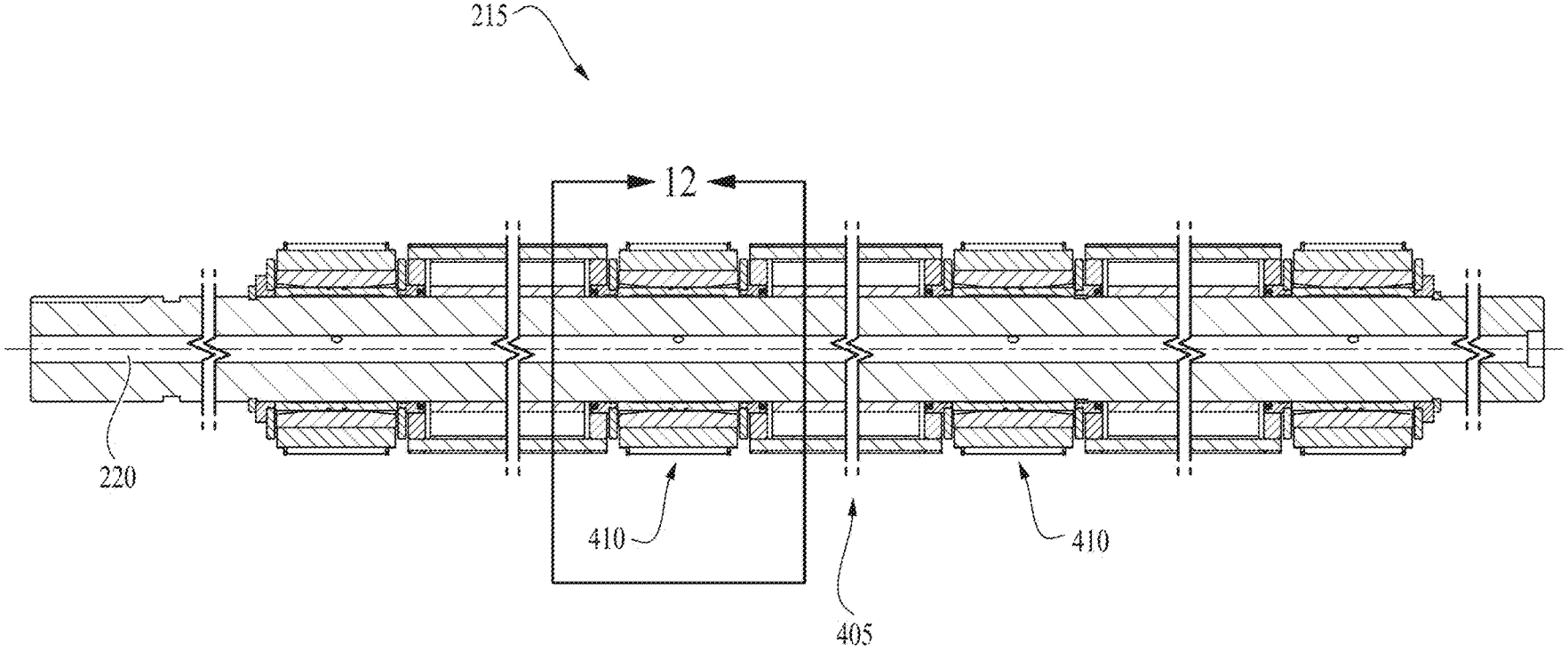
FIG. 11 is an axial cross-section view of the rotor assembly of FIG. 7, according to an embodiment.

The end arrangement depicted in FIG. 10 can comprise a snap ring 1205 located in a corresponding groove (e.g. in the exterior of the shaft 220) at a predefined distance from the shaft end on the shaft 220, and a spacer ring 1210 which may be designed to correspond to the profile of the cage ring 725 of the magnetic rotor module 405. The spacer ring 1210 can be installed concentrically with the steel support 750 with a radial clearance 1019*c* around the steel support sleeve 750. The spacer ring 1210 can touch/abut the support sleeve 750 axially at the contact area 1018. Other embodiments may include a spring loading mechanism. Clearance 1016 may allow the thrust washers 730 to not contact the bushing assembly 510 during the motor operation (e.g. when the rotor assembly 215 is rotating inside the stator assembly 210). In other embodiments this gap may close and result in thrust force on the thrust washer 703.

Figure 13:
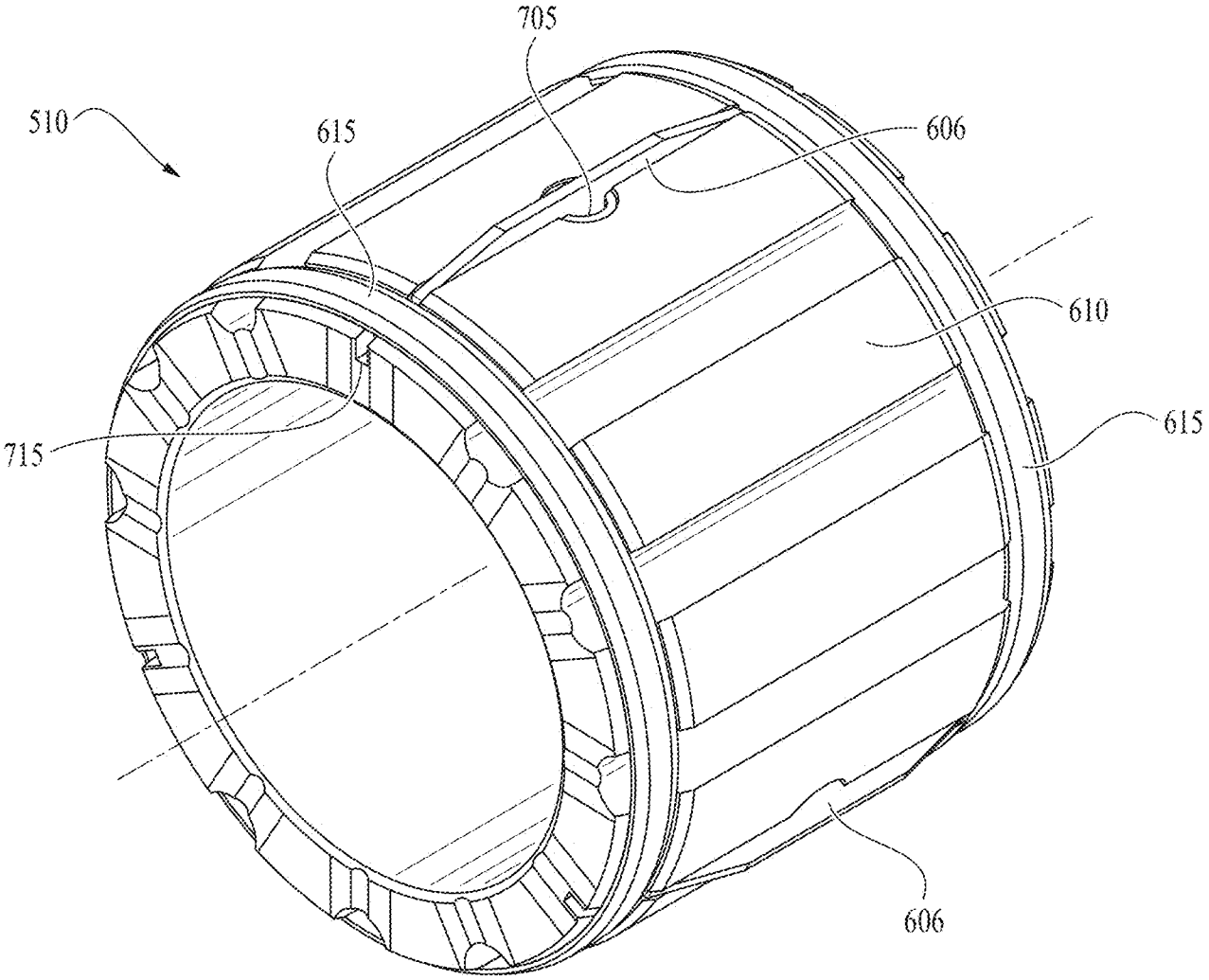
FIG. 13 is an isometric view of an exemplary bushing assembly, according to an embodiment of the disclosure.
Figure 14:
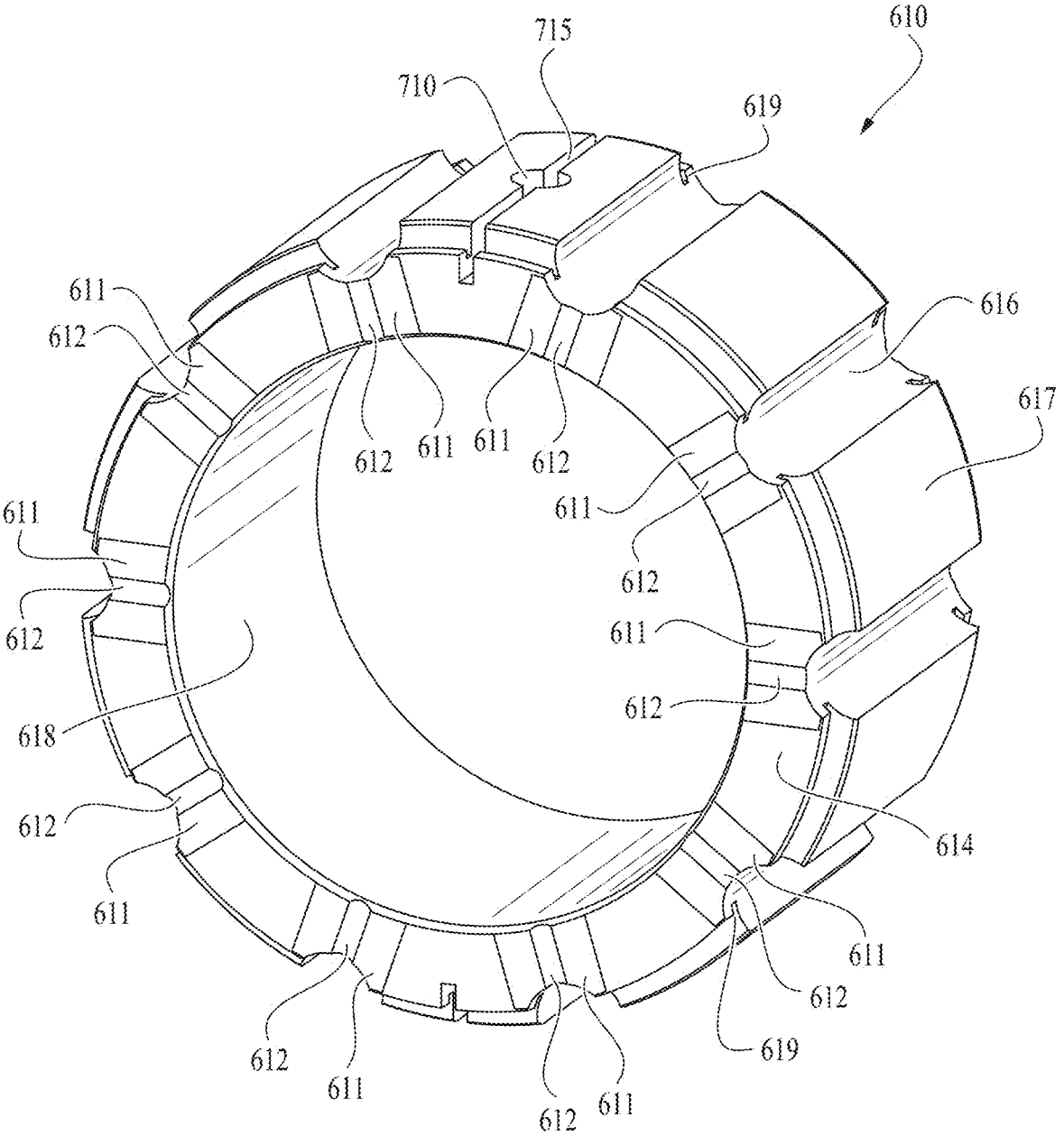
FIG. 14 is a perspective view of the bushing of FIG. 12 according to an embodiment.

An exemplary outer bushing assembly 510, of the sort which might be used in an ESP motor for use downhole in a well as part of an ESP, is shown in FIGS. 13 and 14. The outer bushing assembly 510 can comprise a bushing 610, one or more anti-rotation tabs 606, one or more biasing elements 705, and one or two retention rings 615. Although FIGS. 13 and 14 illustrates an exemplary embodiment having a plurality of anti-rotation tabs 606, with a corresponding plurality of biasing elements 705, the disclosure is not so limited. The bushing 610 may comprise one or more spring recess 710 extending inward from an outer surface of the bushing 610, one or more axial slot 715 on the outer surface of the bushing 610 (e.g. extending axially, such as approximately parallel to the longitudinal axis of the bushing), and one or more slots 619 of the outer surface having a smaller outer diameter than a main body portion of the bushing 610 (e.g. an inwardly/inset stepped portion). Each axial slot 715 may intersect the corresponding spring recess 710 and axial face 614. In embodiments, the bushing 610 is substantially cylindrical about a longitudinal axis.

Figure 12:
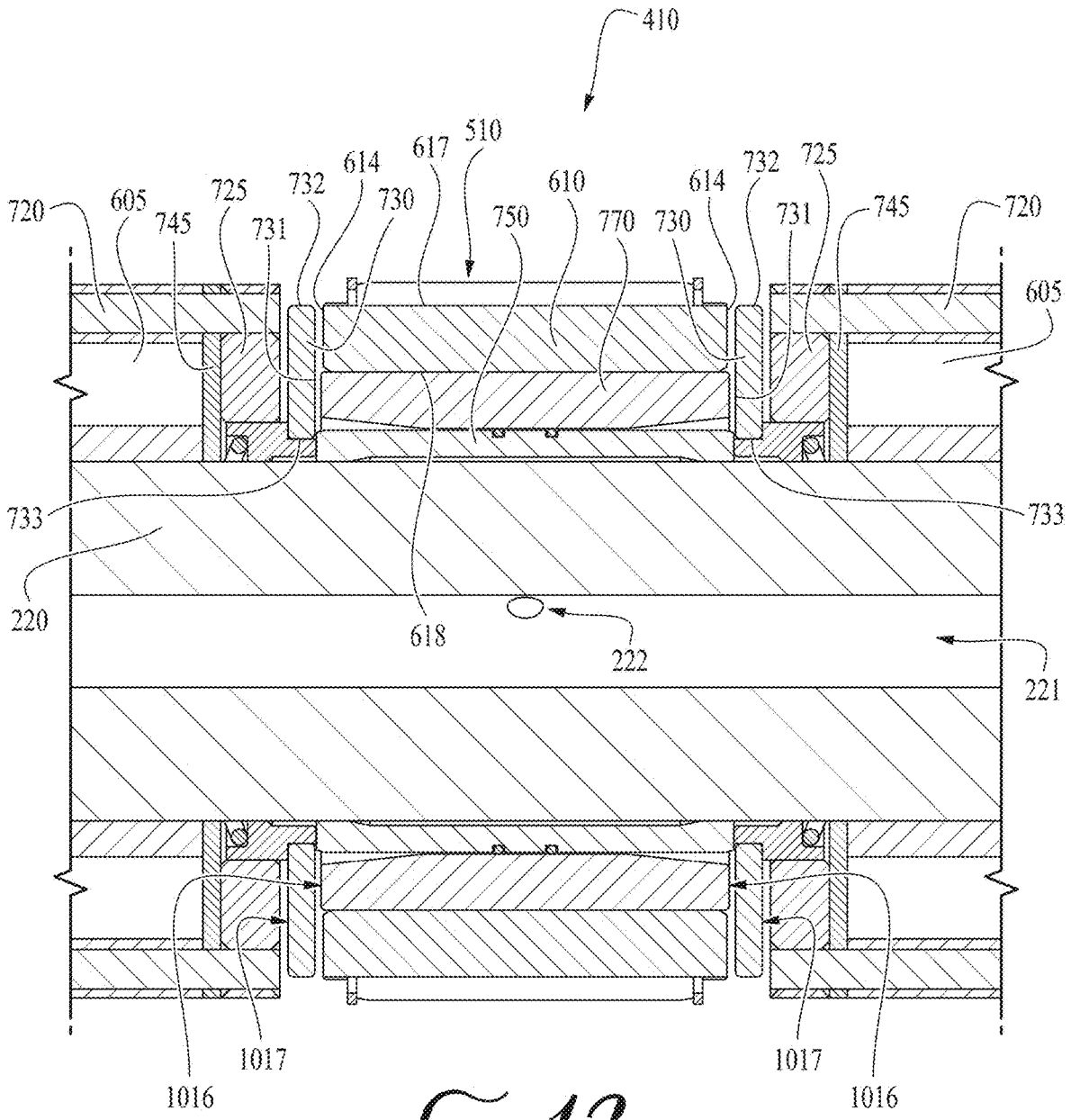
FIG. 12 is an enlarged portion of the axial cross-section view of the rotor assembly of FIG. 11, according to an embodiment of the disclosure.

Referring to FIGS. 12 and 14, a rotor assembly 410 for an ESP may include a drive shaft 220; a journal sleeve 770 concentrically disposed about and rotationally fixed to the drive shaft 220; a bushing 610 concentrically disposed about and configured to rotate with respect to the journal sleeve 770; and a thrust washer 730 encircling the drive shaft 220. Concavities 611 may be formed in an axial face 614 of the bushing 610 or an axial face 731 of the thrust washer 730. The axial face 614 of the bushing 610 may be disposed proximate to the axial face 731 of the thrust washer 730, with the gap or open space of the concavities 611 disposed therebetween. The concavities 611 may be configured to influence flow of lubrication fluid (e.g., oil) between the bushing 610 and the thrust washer 730 to create a hydrodynamic force against the bushing 610 and the thrust washer 730 when the drive shaft 220 rotates. The hydrodynamic force may repel the bushing 610 from the washer 730 (e.g., the bushing 610 may experience force in an axial direction away from the washer 730 and the washer 730 may experience force in an axial direction away from the bushing 610). This may prevent the bushing 610 and the washer 730 from touching, and thus wear on the washer 730 may be greatly reduced or eliminated. Essentially, the washer 730 may ride on an oil film configured to act as a hydrodynamic bearing.

Grooves 612 may be formed in the axial face 614 of the bushing or the axial face 731 of the thrust washer 730. The grooves 612 may be on whichever surface the concavities 611 are on. The grooves 612 may be configured to guide lubrication fluid radially outward particularly when the clearance 1016 as shown in FIGS. 9, 10 & 12 is closed when thrust washer 730 is in contact with bushing 610. Centrifugal force may carry the fluid through the grooves 612 from an area proximate the inner circumferential surface 618 of the bushing 610 to the outer circumferential surface 617 of the bushing 610 or from the inner circumferential surface 733 of the thrust washer 730 to the outer circumferential surface 732 of the thrust washer 730. The axial face 614 of the bushing 610 may be approximately parallel to the axial face 731 of the thrust washer 730. The concavities 611 may include a converging wedge shape. The converging wedge shape may act as a ramp for the fluid so that the fluid will be forced into a small space between the bushing 610 and the washer 730 and thus cause a pressure increase and thus force. This hydrodynamic force may prevent contact between the bushing 610 and the thrust washer 730 when the drive shaft 220 rotates. The grooves 612 may extend deeper than the concavities 611. In some embodiments, grooves 612 may be formed in the concavities 611. In some embodiments, grooves 612 may be disposed between the concavities 611. In some embodiments, grooves 612 may be formed both in the concavities 611 and between the concavities 611.

In embodiments, the concavities may each comprise a shallow, converging wedge shape, for example in which the span of the concavity is significantly greater (e.g. for example 500-10,000; 500-5,000, 5,000-10,000; 1,000-10,000; 1,000-5,000; 3,000-10,000; 3,000-5,000; 5,000-7,000; 7,000-10,000, 500-1,000; 500-3,000; 1,000-3,000, or 3,000-10,000) than its depth and/or with the depth narrowing towards one or more edges. In some embodiments, the concavities may have a curvature/arc with a radius which is orders of magnitude greater than its depth (e.g., arc multiple), for example 500-10,000; 500-5,000, 5,000-10,000; 1,000-10,000; 1,000-5,000; 3,000-10,000; 3,000-5,000; 5,000-7,000; 7,000-10,000, 500-1,000; 500-3,000; 1,000-3,000, or 3,000-10,000 times its depth. For example, the radius of curvature for the concavities may be greater than or approximately 200 mm (e.g. 100-1000 mm) while the depth of the concavities may be approximately 0.01-0.5 mm, 0.05-0.4 mm, 0.05-0.25 mm, 0.05-0.1 mm, 0.1-0.5 mm, or 0.1-0.25 mm.

Figure 15A:
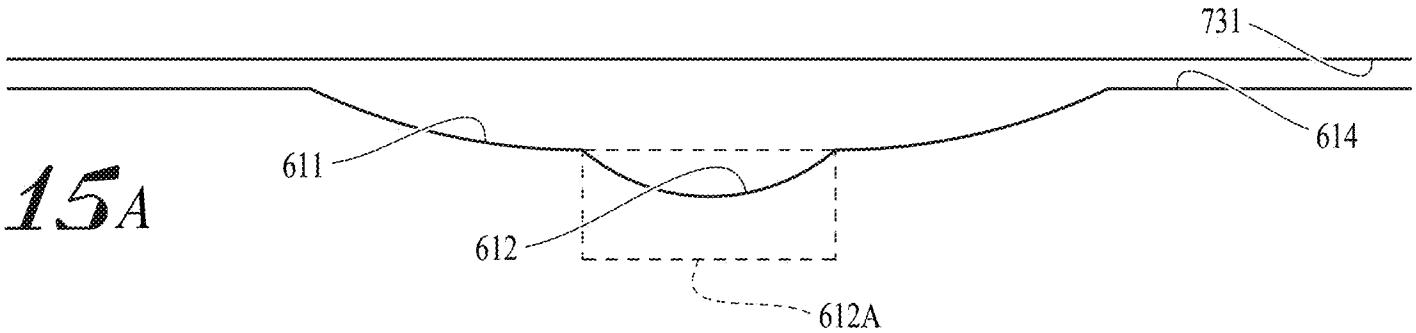
FIG. 15A is a schematic diagram of the interface between the bushing and the thrust washer, according to an embodiment.

Referring to FIG. 15A, the concavity 611 may have an arcuate profile in which an angle between the arcuate profile and the axial face 614 of the bushing 610 (or the axial face 731 of the thrust washer 730) decreases moving towards the center of the concavity. The shape may a segment of a circle, a segment of an oval, a parabola, or an irregular shape, and/or may form a scallop. In some embodiments, the profile is symmetrical, which may have the advantage of allowing the bushing 610 to rotate clockwise or counterclockwise with no change in the hydrodynamic effect of the concavities 611. In some embodiments, the profile may be asymmetrical (for example, similar to half of the concavity shown in FIG. 15A). The groove 612, if formed in the concavity 611, may be formed at the center of the arcuate profile or offset with respect to the center of the arcuate profile. In FIG. 15, the solid line represents the profile of the concavity 611 with the optional groove 612 and the dashed line 612A represents the profile of the concavity 611 without the optional groove 612.

Figure 15B:
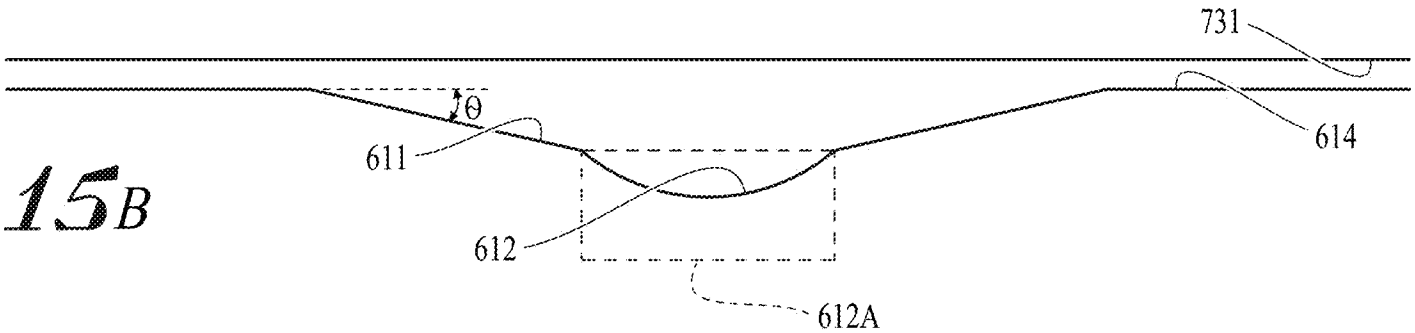
FIG. 15B is a schematic diagram of the interface between the bushing and the thrust washer according, to another embodiment.

Referring to FIG. 15B, the concavity may alternatively have a V-shaped profile. That is, a depth of the concavity 611 may increase or decrease in a linear fashion moving from one side of the concavity 611 to the other, or the depth of the concavity 611 may decrease moving from a center of the concavity 611 to an end of the concavity 611. For example, the concavities may each comprise one or more chamfer, having a very shallow angle θ (e.g. 0.005-0.05 degrees, 0.01-5 degrees, 0.01-0.1 degrees, 0.01-2.5 degrees, 0.1-2.5 degrees, 0.01-1 degrees, 0.1-10 degrees, or 0.05-0.1 degrees). The dashed line shows an embodiment where in the absence of the groove 612 the profile levels out towards the center, but in other embodiments the profile comes together at an angle (e.g., sharp or rounded). In some embodiments, the leveled-out portion could be relatively longer or shorter than what is shown in FIG. 15B. The groove 612 may be formed at the center of the V-shaped profile. The groove 612 is shown in FIG. 15 as having an arcuate profile but in other embodiments, the groove 612 could have a square, triangular, or irregularly shaped profile. An exemplary rectangular embodiment is denoted with reference numeral 612A.

Figure 15C:
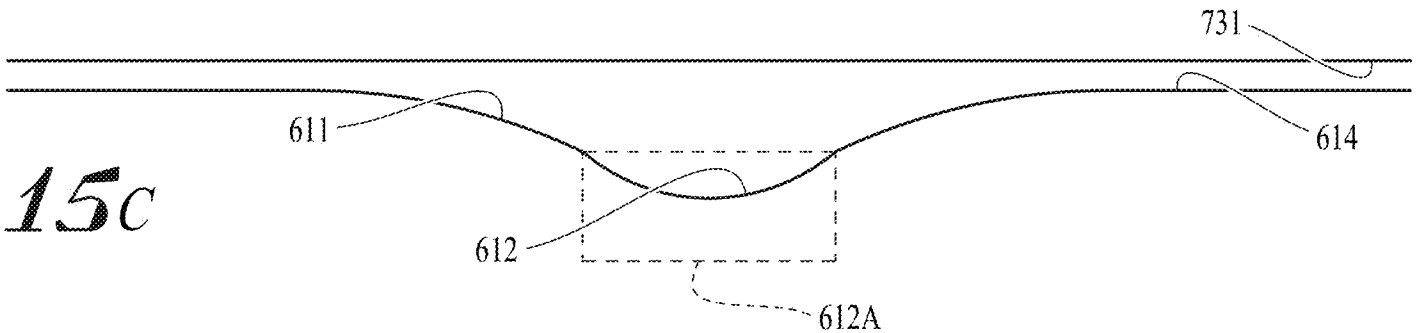
FIG. 15C is a schematic diagram of the interface between the bushing and the thrust washer, according to yet another embodiment.

Referring to FIG. 15C, the concavity 611 may have an actuate profile in which an angle between the arcuate profile and the axial face 614 of the bushing 610 (or the axial face 731 of the thrust washer 730) increases moving towards a center of the concavity 611. In embodiments, such concavities may be similar in shape to the chamfer of FIG. 15B, but with a radius of curvature (e.g. fillet radius) in place of a linear angled surface. The groove 612 may be formed at the center of the actuate profile, at another location within the arcuate profile, or be absent from the concavity 611 altogether. In the embodiment shown in FIG. 15C where there is a groove 612, the groove 612 may start at or be disposed between inflection points of the curve defining the concavity 611. In embodiments where there is no groove 612 in the concavity 611, the profile of the concavity 611 may have a flat portion (e.g., in the middle of the concavity 611) or may have a U-shaped curvature in the middle or at another location on the concavity 611.

In view of the various profiles shown in FIG. 15, it can be seen that fluid may enter the concavity 611 from one direction, be drawn into the concavity 611, and then be expelled out of the concavity on the other side. When the fluid is expelled, it may be forced into a small gap between the bushing 610 and the thrust washer 730 (e.g. formed by a converging wedge portion of the concavity and/or narrowing of the depth of the concavity, for example with the volume of fluid being forced into a progressively shallower gap) and thus maintain separation of the thrust washer 730 and the bushing 610 while the shaft 220 turns. That is, the fluid dynamics caused by the concavity may repel the bushing 610 from the thrust washer 730 so that they do not touch when the shaft 220 rotates. The configuration/shape of the concavities may be selected to provide the hydrodynamic force for separating the busing 610 and thrust washer 730 due to fluid dynamics, effectively providing a hydrodynamic bearing between the busing 619 and the thrust washer 730. Although the exemplary embodiments of FIG. 15 shows that the concavity 611 and the optionally the groove 612 are formed on the bushing 610 and the thrust washer 730 is flat, in some embodiments, the concavity 611 and optionally the groove 612 are formed on the thrust washer 730 and the bushing 610 is flat. Regardless, the opening/gap formed by the concavities 611 may be disposed between the axial faces of the bushing 610 and the thrust washer 730. In some embodiments, the width of the groove 612 is one quarter or less the width of the concavity 611. In some embodiments, the concavities 611 are equally spaced around the bushing 610 or the thrust washer 730 (e.g., they are spaced apart by a constant interval). In some embodiments, the number of concavities 611 is ten, but any number greater than one is within the scope of the present disclosure (e.g. 2-10, 3-10, 4-10, 6-10, 8-10, 4-8, or 6-8 concavities may be spaced around the bushing 610 or thrust washer 730). In some embodiments, the number of grooves 612 is eight to twelve, but any number greater than one is within the scope of the present disclosure. In some embodiments, the number of grooves 612 may equal the number of concavities 611 (for example, with each concavity 611 having a corresponding groove 612 therein).

It should be noted that FIGS. 15A-C are not to scale, but purposefully exaggerate the depth of the concavity (e.g. with respect to the radius of curvature) for ease of viewing various elements thereof.

Figure 16:
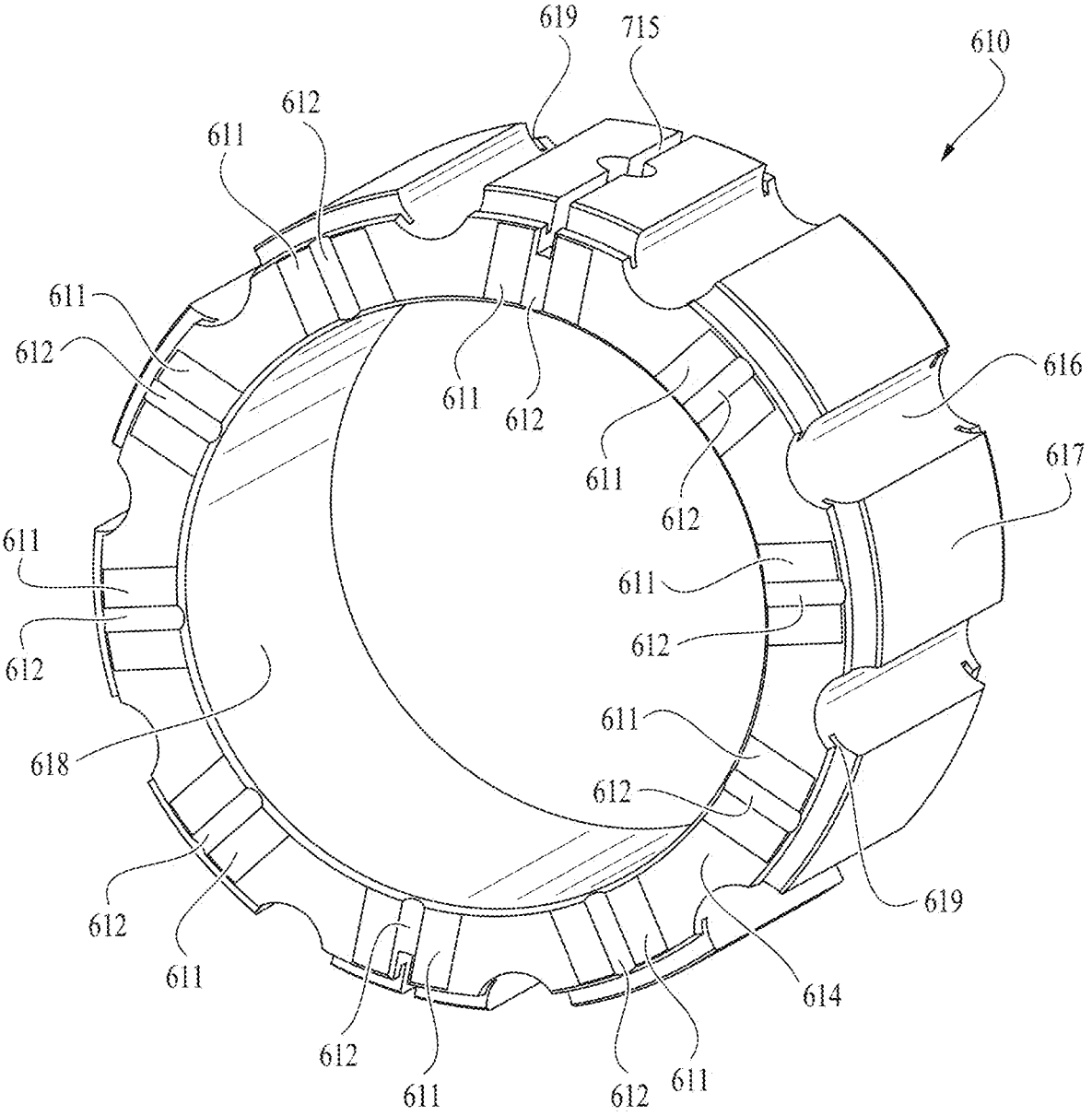
FIG. 16 is a perspective view of the bushing of FIG. 12, according to another embodiment.

Referring again to FIGS. 12 and 14, the concavities 611 and the grooves 612 may be formed in the axial face 614 of the bushing 610. Channels 616 may be formed in an outer circumferential surface 617 of the bushing 610 and/or extend from the axial face 614 of the bushing 610 to another axial face 614 of the bushing 610. The channels 616 may be approximately parallel to each other. The concavities 611 and/or the grooves 612 may extend from the inner circumferential surface 618 of the bushing towards the outer circumferential surface 617 of the bushing 610 such that the concavities 611 and/or the grooves 612 span across the entire axial face 614 of the bushing 610. The concavities 611 and/or the grooves 612 may have radial symmetry. In the embodiment of FIG. 14, the grooves 612 may be angularly aligned with the channels 616 and/or the concavities 611 may be angularly aligned with the channels 616. In the embodiment of FIG. 16, the grooves 612 may be angularly offset from the channels 616 and/or the concavities 611 may be angularly offset from the channels 616. In some embodiments, edges of the concavities 611 do not overlap with the channels 616. The location of the concavities 611 can be arbitrarily selected to maximize the axial force.

Figure 17:
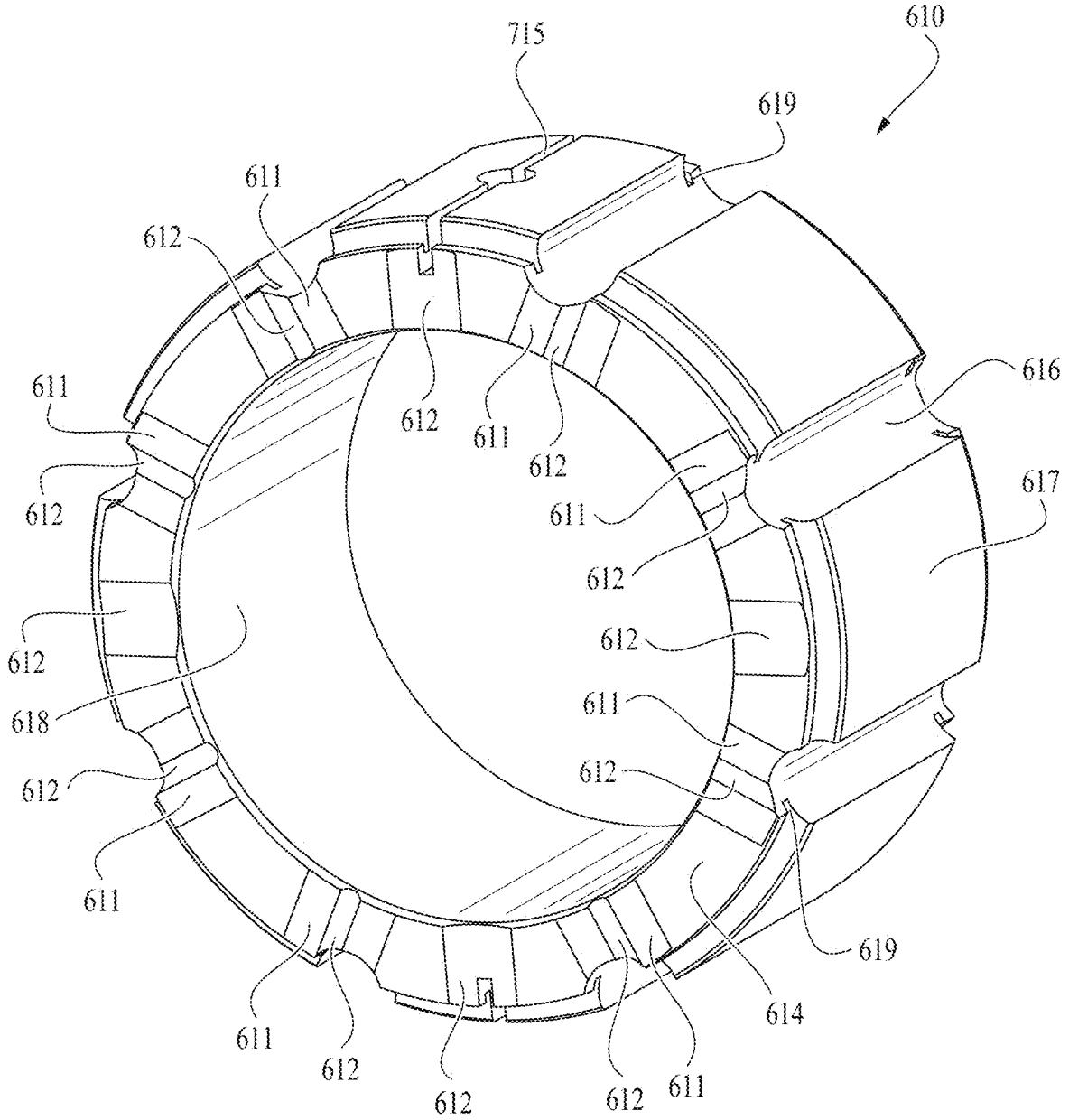
FIG. 17 is a perspective view of the bushing of FIG. 12, according to yet another embodiment.

In some embodiments, such as the embodiment of FIG. 17, additional grooves 612 may be disposed between the concavities 611 which may also have grooves 612. The grooves 612 disposed between the cavities 611 may be wider and/or deeper than the grooves 612 disposed in the concavities 611. Any suitable combination or arrangement of stand-alone concavities 611, stand-alone grooves 612, and/or grooves 612 formed in concavities 611 is within the scope of the present disclosure.

Figure 18A:
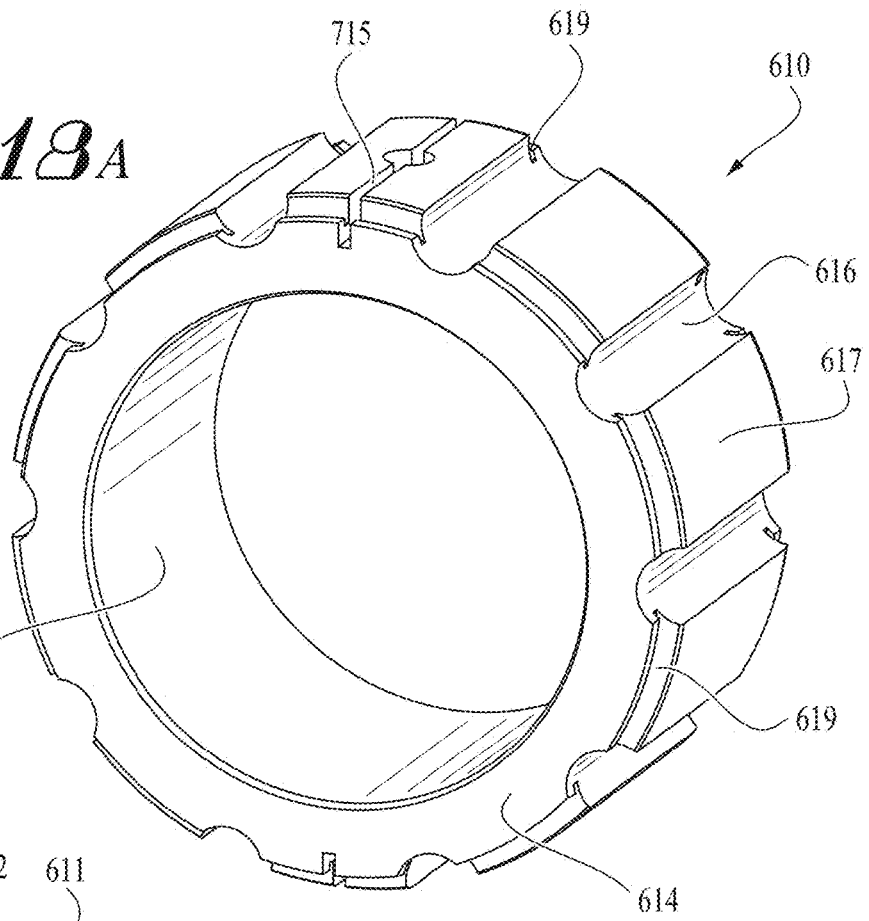
FIG. 18A is a perspective view of the bushing of FIG. 12, according to yet another embodiment.
Figure 18B:
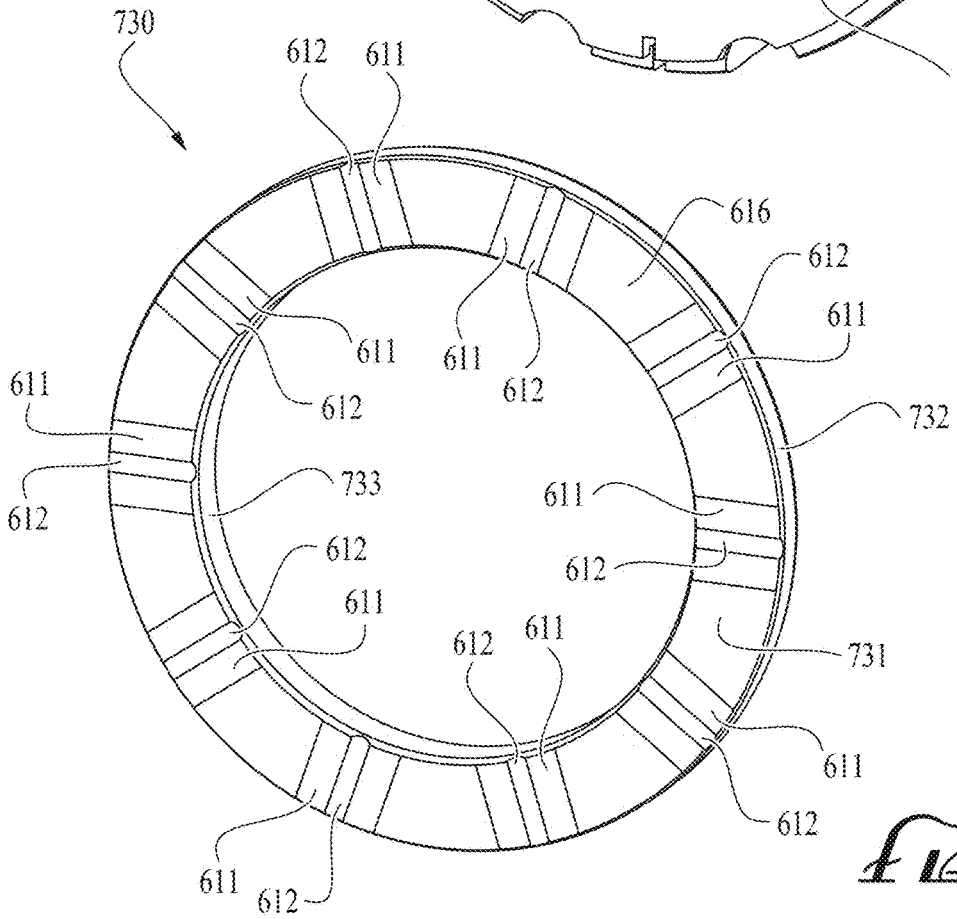
FIG. 18B is a perspective view of the thrust washer of FIG. 12, according to the embodiment of FIG. 18A.

Referring to FIGS. 18A and 18B, the axial face 614 of the bushing 610 may be flat (i.e., there may be no concavities 611 nor grooves 612 on the axial face 614 of the bushing 610). The outer circumferential surface 617 of the bushing 610 may also be unbroken (i.e., there may be no channels 616 formed in the outer circumferential surface 617). Instead, channels 616 may be formed in an outer circumferential surface 732 of the thrust washer 730 (e.g., extending from the axial face 731 of the thrust washer 730 to another axial face 731 of the thrust washer 730). The concavities 611 and the grooves 612 may extend from an inner circumferential surface 733 of the thrust washer 730 towards an outer circumferential surface 732 of the thrust washer 730 such that the concavities 611 and the grooves 612 span across the entire axial surface 731 of the thrust washer 730. Any configuration of concavities 611, grooves 612 and/or channels 616 disclosed herein as being applied to the bushing 610 may also be applied to the thrust washer 730 or the end face of the rotor module 405, case ring 725, spacer ring 1210, or any other suitable element.

Referring to FIG. 12, the thrust washer 730 may be concentrically disposed about the drive shaft 220. The journal sleeve 770 may be disposed between the drive shaft 220 and the bushing 610. An outer diameter of the thrust washer 730 may be greater than or equal to an inner diameter of the bushing 610. In some embodiments, the outer diameter of the thrust washer 730 may extend to be adjacent to at least half of the axial face of the bushing 610. An outer diameter of the thrust washer 730 may be approximately equal to an outer diameter of the bushing 610 or may be greater than the outer diameter of the bushing 610. There may be two thrust washers 730 (i.e., a washer 730 and another washer 730), and the bushing 610 may be disposed between the two thrust washers 730. The length of the bushing 610 may be approximately the same as the length of the inner journal sleeve 770. The bushing 610 and/or the inner journal sleeve 770 may be disposed entirely within a plane defined by an inner axial face 731 of the thrust washer 730 and an inner axial face 731 of the other thrust washer 730. The axial faces of the inner journal sleeve 770 may be proximate to the inner axial faces 731 of the washer 730 and may be coplanar with the axial faces 614 of the bushing 610. The axial faces 614 of the bushing 610 may be approximately parallel to the inner axial faces 731 of the thrust washers 730.

Figure 19:
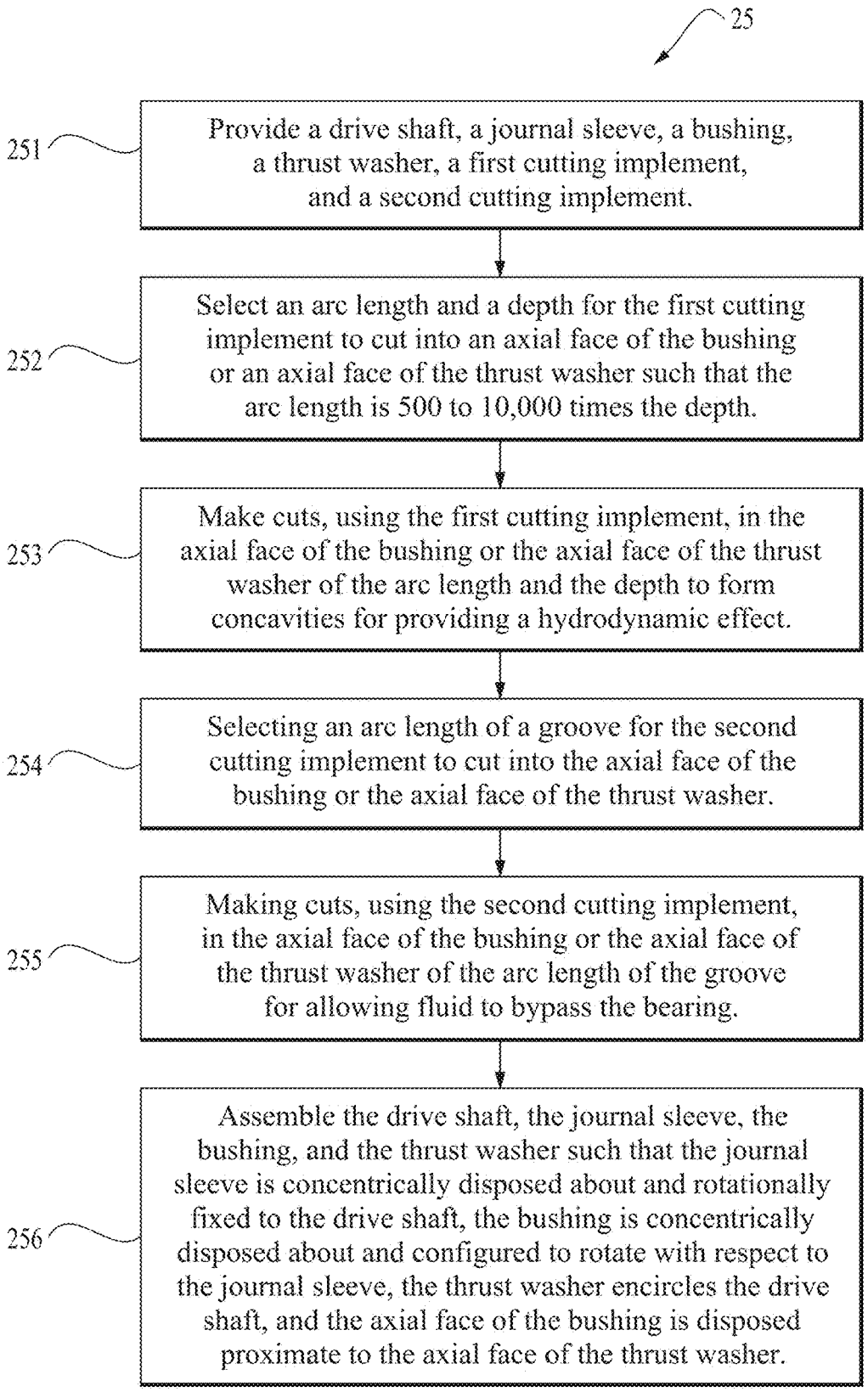
FIG. 19 is a flow diagram of an exemplary method of making a rotor assembly for an ESP, according to an embodiment.

Referring to FIG. 19, a method 25 of making a rotor assembly for an electric submersible pump may include the step 251 of providing a drive shaft, a journal sleeve, a bushing, a thrust washer, a first cutting implement, and/or a second cutting implement; the step 252 of selecting an arc length and a depth for the first cutting implement to cut into an axial face of the bushing or an axial face of the thrust washer such that the arc length is 500-10,000 times the depth (or any other arc multiple disclosed herein); the step 253 of making cuts, using the first cutting implement, in the axial face of the bushing or the axial face of the thrust washer of the arc length and the depth to form concavities for providing a hydrodynamic effect; the step 254 of providing a second cutting implement (e.g. with a different cutting radius than the initial cutting implement), selecting an arc length and/or a depth of a groove for the second cutting implement to cut into the axial face of the bushing or the axial face of the thrust washer such that the arc length of the concavity is at least two times the arc length of the groove (e.g., 2-8 times) and/or such that the cross-sectional area of the groove is approximately 125 times larger than that of the concavities (e.g. a depth of approximately 0.3-1 mm, 1-2 mm, 1-1.5 mm, 1.5-3 mm, or 1.5-6 mm) for allowing fluid to bypass the bearing; the step 255 of making cuts, using the second cutting implement, in the axial face of the bushing or the axial face of the thrust washer of the arc length and/or depth of the groove to form the groove (the grooves may be formed in the concavities); and/or the step 256 of assembling the drive shaft, the journal sleeve, the bushing, and the thrust washer such that the journal sleeve is concentrically disposed about and rotationally fixed to the drive shaft, the bushing is concentrically disposed about and configured to rotate with respect to the journal sleeve, the thrust washer encircles the drive shaft, and the axial face of the bushing is disposed proximate to the axial face of the thrust washer. In embodiments, the depth of the cut may be approximately 0.01-0.5 mm, 0.05-0.4 mm, 0.05-0.25 mm, 0.05-0.1 mm, 0.1-0.5 mm, or 0.1-0.25 mm. A number of the cuts may be selected based on an inner circumference of the bushing or thrust washer and/or a surface area of an axial surface of the bearing or thrust washer and/or the width of each cut. The cut may be an arc cut. The cut may be made by a CNC machine or any other suitable machine. The bushing and/or the thrust washer may be integrally formed. That is, the bushing and/or the thrust washer may be a solid piece of material, and it may be machined to form the concavities. The bushing and/or the thrust washer may be made from steel, brass, tungsten carbide, or any other suitable material.

Referring to FIGS. 1, 12, and 14, an exemplary electric submersible pump 106 for pumping fluid in a wellbore 102 may include a centrifugal pump 116; a drive shaft 220 configured to transmit torque to the centrifugal pump 116; a stator 210 configured to drive the drive shaft 220; a journal sleeve 770 concentrically disposed about and rotationally fixed to the drive shaft 220; a bushing 610 concentrically disposed about and configured to rotate with respect to the journal sleeve 770; and a thrust washer 730 encircling the drive shaft 220. The bushing 610 may contact and slide against (e.g. rotate with respect to) the inner journal sleeve 770. The inner journal sleeve 770 may be fixed with respect to the adjacent support sleeve 750, which is fixed with respect to the shaft 220. Oil (or other lubrication fluid) may flow through the bore 221 in the drive shaft 220 and into the oil hole 222. The oil may then enter the gap between the bushing 610 and the thrust washer 730. Concavities 611 may be formed in an axial face 614 of the bushing 610 or an axial face 731 of the thrust washer 730. The axial face 614 of the bushing 610 may be disposed proximate to the axial face 614 of the thrust washer 730 (e.g. with the gap formed by the concavities therebetween). The concavities may be configured to influence flow of lubrication fluid (e.g., oil) between the bushing 610 and the thrust washer 730 to create a hydrodynamic force against the bushing 610 and the thrust washer 730 (e.g. separating the two) when the drive shaft 220 rotates. In other words, the concavities may be configured to influence flow of lubrication fluid (e.g., oil) between the bushing 610 and the thrust washer 730 to create a hydrodynamic film between the bushing 610 and the thrust washer 730 when the drive shaft 220 rotates, which provides the hydrodynamic forces that tend to separate the bushing from the thrust washer (or alternatively, separate the bushing from another component in proximity to the axial face of the bushing). The hydrodynamic film may provide a hydrodynamic bearing effect between the bushing and the thrust washer. The drive shaft 220 may be oriented in the wellbore 102 vertically. A first slot 619 may formed in the outer circumferential surface 617 of the bushing 610 proximate the axial face 614 of the bushing. A second slot 619 may be formed in the outer circumferential surface 617 of the bushing 610 proximate another axial face 614 of the bushing 610. An anti-rotation tab 606 may be secured in a longitudinal slit (e.g., axial slot 715) in the outer circumferential surface 617 of the bushing 610 by a first retention ring 615 disposed in the first slot 619 and a second retention ring 615 disposed in the second slot 619. The anti-rotation tab 606 may be inserted inside a slot in the stator 210.

Because of the configuration of the rotor assembly 410, and in particular because of the configuration of the concavities 611, life of the rotor assembly 410 may be greatly extended as compared with the conventional art. In particular, the inventors have surprisingly discovered that adding the concavities 611 having the arc radius of 500-10,000; 500-5,000; 5,000-10,000, 1,000-10,000; 1,000-5,000; 3,000-5,000; 3,000-10,000, 5,000-7,000; or 7,000-10,000 times the depth can extend the life of the rotor assembly 410 significantly, for example one thousand-fold. Depending on the application (for example, the operating speed, operating temperature, oil grade, and dimension of the parts), the hydrostatic force generated by the concavities 611 may be in the range of 5 to 1,000 Newtons, or alternately 5-500 Newtons, 5-100 Newtons, 50-1,000 Newtons, 50-500 Newtons, 50-100 Newtons, 100-1,000 Newtons, 100-500 Newtons, 500-1,000 Newtons, 500-750 Newtons, 750-1,000 Newtons, or more. The improved longevity as compared with the conventional art may allow the ESP to pump fluid in the well with reduced downtime, thus improving efficiency and reducing costs in extracting oil.

ADDITIONAL DISCLOSURE

The following are non-limiting, specific embodiments in accordance with the present disclosure:

In a first embodiment, a rotor assembly for an electric submersible pump comprises a drive shaft; a journal sleeve concentrically disposed about and rotationally fixed to the drive shaft; a bushing concentrically disposed about and configured to rotate with respect to the journal sleeve; and a thrust washer encircling the drive shaft, wherein concavities are formed in an axial face of the bushing or an axial face of the thrust washer, wherein the axial face of the bushing is disposed proximate to the axial face of the thrust washer, and wherein the concavities are configured to influence flow of lubrication fluid between the bushing and the thrust washer to create a hydrodynamic force against the bushing and the thrust washer when the drive shaft rotates.

A second embodiment can include the rotor assembly of the first embodiment, wherein grooves are formed in the axial face of the bushing or the axial face of the thrust washer.

A third embodiment can include the rotor assembly of the first or second embodiments, wherein the axial face of the bushing is approximately parallel to the axial face of the thrust washer.

A fourth embodiment can include the pump of any of the first through third embodiments, wherein the grooves are configured to guide lubrication fluid radially outward.

A fifth embodiment can include the rotor assembly of any of the first through fourth embodiments, wherein concavities comprise a converging wedge shape.

A sixth embodiment can include the rotor assembly of any of the first through fifth embodiments, wherein the hydrodynamic force prevents contact between the bushing and the thrust washer when the drive shaft rotates.

A seventh embodiment can include the rotor assembly of any of the first through sixth embodiments, wherein the grooves extend deeper than the concavities.

An eighth embodiment can include the rotor assembly of any of the first through seventh embodiments, wherein the grooves are formed in the concavities.

A ninth embodiment can include the rotor assembly of any of the first through eighth embodiments, wherein the grooves are disposed between the concavities.

A tenth embodiment can include the rotor assembly of any of the first through ninth embodiments, wherein the concavity comprises an arcuate profile, wherein an angle between the arcuate profile and the axial face of the bushing or the axial face of the thrust washer decreases moving towards a center of the concavity.

An eleventh embodiment can include the rotor assembly of any of the first through tenth embodiments, wherein the groove is formed at the center of the arcuate profile.

A twelfth embodiment can include the rotor assembly of any of the first through eleventh embodiments, wherein the concavity comprises a V-shaped profile.

A thirteenth embodiment can include the rotor assembly of any of the first through twelfth embodiments, wherein the groove is formed at a center of the V-shaped profile.

A fourteenth embodiment can include the rotor assembly of any of the first through thirteenth embodiments, wherein the concavity comprises an actuate profile, wherein an angle between the arcuate profile and the axial face of the bushing or the axial face of the thrust washer increases moving towards a center of the concavity.

A fifteenth embodiment can include the rotor assembly of any of the first through fourteenth embodiments, wherein the groove is formed at the center of the actuate profile.

A sixteenth embodiment can include the rotor assembly of any of the first through fifteenth embodiments, wherein the concavities and the grooves are formed in the axial face of the bushing.

A seventeenth embodiment can include the rotor assembly of the sixteenth embodiment, further comprising channels formed in an outer circumferential surface of the bushing and extending from the axial face of the bushing to another axial face of the bushing.

An eighteenth embodiment can include the rotor assembly of any of the sixteenth through seventeenth embodiments, wherein the concavities and the grooves extend from an inner circumferential surface of the bushing towards an outer circumferential surface of the bushing such that the concavities and the grooves span across the entire axial face of the bushing.

A nineteenth embodiment can include the rotor assembly of any of the sixteenth through eighteenth embodiments, wherein the grooves are angularly aligned with the channels.

A twentieth embodiment can include the rotor assembly of any of the sixteenth through nineteenth embodiments, wherein the grooves are angularly offset from the channels.

A twenty-first embodiment can include the rotor assembly of any of the sixteenth through twentieth embodiments, wherein the concavities are angularly aligned with the channels.

A twenty-second embodiment can include the rotor assembly of any of the sixteenth through twenty-first embodiments, wherein the concavities are angularly offset from the channels.

A twenty-third embodiment can include the rotor assembly of any of the first through fifteenth embodiments, wherein the concavities and the grooves are formed on the axial face of the thrust washer.

A twenty-fourth embodiment can include the rotor assembly of any of the first through fifteenth and twenty-third embodiments, further comprising channels formed in an outer circumferential surface of the thrust washer and extending from the axial face of the thrust washer to another axial face of the thrust washer.

A twenty-fifth embodiment can include the rotor assembly of any of the first through fifteenth and twenty-third through twenty-fourth embodiments, wherein the concavities and the grooves extend from an inner circumferential surface of the thrust washer towards an outer circumferential surface of the thrust washer such that the concavities and grooves span across the entire axial face of the thrust washer.

A twenty-sixth embodiment can include the rotor assembly of any of the first through twenty-fifth embodiments, wherein the thrust washer is concentrically disposed about the drive shaft.

A twenty-seventh embodiment can include the rotor assembly of any of the first through twenty-sixth embodiments, wherein the journal sleeve is disposed between the drive shaft in the bushing.

A twenty-eighth embodiment can include the rotor assembly of any of the first through twenty-seventh embodiments, wherein an outer diameter of the thrust washer is greater than or equal to an inner diameter of the bushing.

A twenty-ninth embodiment can include the rotor assembly of any of the first through twenty-eighth embodiments, wherein an outer diameter of the thrust washer is approximately equal to an outer diameter of the bushing.

A thirtieth embodiment can include the rotor assembly of any of the first through twenty-ninth embodiments, further comprising another thrust washer, wherein the bushing is disposed between the thrust washer and the other thrust washer.

In a thirty-first embodiment, a method of making a rotor assembly for an electric submersible pump comprises providing a drive shaft, a journal sleeve, a bushing, a thrust washer, and a cutting implement; selecting an arc length and a depth for the cutting implement to cut into an axial face of the bushing or an axial face of the thrust washer such that the arc length is 500-10,000 times the depth; making cuts, using the cutting implement, in the axial face of the bushing or the axial face of the thrust washer of the arc length and the depth to form concavities; and assembling the drive shaft, the journal sleeve, the bushing, and the thrust washer such that the journal sleeve is concentrically disposed about and rotationally fixed to the drive shaft, the bushing is concentrically disposed about and configured to rotate with respect to the journal sleeve, the thrust washer encircles the drive shaft, and the axial face of the bushing is disposed proximate to the axial face of the thrust washer with the concavity therebetween. In some embodiments, the concavities are 200 microns in height or less. In some embodiments, the arc radius is 100-1000 mm. In some embodiments, the arc radius is greater than 5,000 times the depth, greater than 1,000 times the depth, greater than 10,000 times the depth, 500-10,000 times the depth, 500-5,000 times the depth, 1,000-5,000 times the depth, or 5,000 to 10,0000 times the depth. In some embodiments, the arc length is approximately 5,000 times the depth. In some embodiments, the arc length of the concavities is 2-20 mm. In some embodiments, the angle of the wedge of the concavities is 0.005 degrees to 10 degrees. In some embodiments, the angle of the wedge of the concavities is approximately 0.1 degree. The method of the thirty-first embodiment may be the method of making the rotor assembly of any of the first through thirtieth embodiments.

A thirty-second embodiment can include the method of the thirty-first embodiment, wherein a number of the cuts is selected based on an inner circumference of the thrust washer and the width of each cut.

A thirty-third embodiment can include the method of the thirty-first or thirty-second embodiments, wherein the cut is an arc cut.

A thirty-fourth embodiment can include the method of any of the thirty-first through thirty-third embodiments, wherein the cut is made by a CNC machine.

A thirty-fifth embodiment can include the method of any of the thirty-first through thirty-fourth embodiments, further comprising providing another cutting implement, selecting an arc length of a groove for the other cutting implement to cut into the axial face of the bushing or the axial face of the thrust washer such that the arc length of the concavity is at least four times the arc length of the groove, and making cuts, using the other cutting implement, in the axial face of the bushing or the axial face of the thrust washer of the arc length of the groove to form the groove.

A thirty-sixth embodiment can include the method of any of the thirty-first through thirty-fifth embodiments, wherein the grooves are formed in the concavities.

A thirty-seventh embodiment can include the method of any of the thirty-first through thirty-sixth embodiments, wherein the bushing is integrally formed.

A thirty-eighth embodiment can include the method of any of the thirty-first through thirty-seventh embodiments, wherein the thrust washer is integrally formed.

In a thirty-ninth embodiment, an electric submersible pump for pumping fluid in a wellbore comprises a centrifugal pump; a drive shaft configured to transmit torque to the centrifugal pump; a stator configured to drive the drive shaft; a journal sleeve concentrically disposed about and rotationally fixed to the drive shaft; a bushing concentrically disposed about and configured to rotate with respect to the journal sleeve; and a thrust washer encircling the drive shaft, wherein concavities are formed in an axial face of the bushing or an axial face of the thrust washer, wherein the axial face of the bushing is disposed proximate to the axial face of the thrust washer, and wherein the concavities are configured to influence flow of lubrication fluid between the bushing and the thrust washer to create a hydrodynamic force against the bushing and the thrust washer when the drive shaft rotates. The electric submersible pump of the thirty-ninth embodiment can include the rotor assembly of any of the first through thirtieth embodiments.

A fortieth embodiment can include the electric submersible pump of the thirty-ninth embodiment, wherein the drive shaft is oriented in the wellbore vertically, horizontally or any intermediate angle.

A forty-first embodiment can include the electric submersible pump of the thirty-ninth or fortieth embodiments, wherein a first slot is formed in the outer circumferential surface of the bushing proximate the axial face of the bushing, a second slot is formed in the outer circumferential surface of the bearing proximate another axial face of the bushing, wherein an anti-rotation tab is secured in a longitudinal slit in the outer circumferential surface of the bushing by a first retention ring disposed in the first slot and a second retention ring disposed in the second slot.

A forty-second embodiment can include the electric submersible pump of any of the thirty-ninth through forty-first embodiments, wherein the anti-rotation tab is inserted inside a slot in the stator.

In a forty-third embodiment, a rotor assembly for an electric submersible pump comprises a drive shaft; a journal sleeve concentrically disposed about and rotationally fixed to the drive shaft; a bushing concentrically disposed about and configured to rotate with respect to the journal sleeve; and a thrust washer encircling the drive shaft, wherein concavities are formed in an axial face of the bushing, wherein the axial face of the bushing is disposed proximate to the axial face of the thrust washer, and wherein the concavities are configured to influence flow of lubrication fluid between the bushing and the thrust washer to create a hydrodynamic film against the bushing and the thrust washer when the drive shaft rotates.

In a forty-fourth embodiment, a rotor assembly for an electric submersible pump comprises a drive shaft; a journal sleeve concentrically disposed about and rotationally fixed to the drive shaft; a bushing concentrically disposed about and configured to rotate with respect to the journal sleeve; and a thrust washer encircling the drive shaft, wherein concavities are formed in an axial face of the thrust washer, wherein the axial face of the bushing is disposed proximate to the axial face of the thrust washer, and wherein the concavities are configured to influence flow of lubrication fluid between the bushing and the thrust washer to create a hydrodynamic force against the bushing and the thrust washer when the drive shaft rotates.

In a forty-fifth embodiment, a bushing for an electric submersible pump comprises an annulus, wherein concavities are formed in an axial face of the annulus, wherein the concavities are configured to influence flow of lubrication fluid between the bushing and a thrust washer to create a hydrodynamic force against the bushing and the thrust washer when the drive shaft rotates, wherein grooves are formed in the axial face of the annulus, wherein the grooves are configured to guide lubrication fluid radially outward.

In a forty-sixth embodiment, a thrust washer for an electric submersible pump comprises an annulus, wherein concavities are formed in an axial face of the annulus, wherein the concavities are configured to influence flow of lubrication fluid between the bushing and a thrust washer to create a hydrodynamic force against the bushing and the thrust washer when the drive shaft rotates, wherein grooves are formed in the axial face of the annulus, wherein the grooves are configured to guide lubrication fluid radially outward.

A forty-seventh embodiment can include the rotor assembly of any of the first through fifteenth embodiments, wherein the concavities and the grooves are formed on the axial face of another component acting as the thrust washer While embodiments have been shown and described, modifications thereof can be made by one skilled in the art without departing from the spirit and teachings of this disclosure. The embodiments described herein are exemplary only and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. A rotor assembly for an electric submersible pump, comprising:

a drive shaft;

a journal sleeve concentrically disposed about and rotationally fixed to the drive shaft;

a bushing concentrically disposed about the journal sleeve; and a thrust washer encircling the drive shaft, wherein concavities are formed in an axial face of the bushing or an axial face of the thrust washer, wherein the axial face of the bushing is disposed proximate to the axial face of the thrust washer, wherein each of the concavities has an arc radius and a depth, wherein the arc radius is greater than 5,000 times the depth, and wherein the concavities are configured to influence flow of lubrication fluid between the bushing and the thrust washer to create a hydrodynamic force against the bushing and the thrust washer when the drive shaft rotates.

2. The rotor assembly of claim 1, wherein grooves are formed in the axial face of the bushing or the axial face of the thrust washer, and wherein the grooves are configured to guide lubrication fluid radially outward.

3. The rotor assembly of claim 1, wherein the hydrodynamic force prevents contact between the bushing and the thrust washer when the drive shaft rotates.

4. The rotor assembly of claim 2, wherein the grooves extend deeper than the concavities, and wherein the grooves are formed in the concavities or between the concavities.

5. The rotor assembly of claim 1, wherein the concavities comprise an arcuate profile or a chamfer.

6. The rotor assembly of claim 1, wherein an angle of a profile of the concavities with respect to the axial face of the bushing or the axial face of the thrust washer is less than 10 degrees.

7. The rotor assembly of claim 1, wherein the depth of the concavities is less than 0.2 mm, and the radius of the concavities is greater than 200 mm.

8. The rotor assembly of claim 1, wherein the hydrodynamic force is 5 to 5,000 N.

9. An electric submersible pump for pumping fluid in a wellbore, comprising:

a centrifugal pump;

a drive shaft configured to transmit torque to the centrifugal pump;

a journal sleeve concentrically disposed about and rotationally fixed to the drive shaft;

a bushing concentrically disposed about the journal sleeve;

a stator concentrically disposed about the bushing; and a thrust washer encircling the drive shaft, wherein concavities are formed in an axial face of the bushing or an axial face of the thrust washer, wherein the axial face of the bushing is disposed proximate to the axial face of the thrust washer, wherein a depth of the concavities is less than 0.2 mm, wherein a radius of the concavities is greater than 200 mm, and wherein the concavities are configured to influence flow of lubrication fluid between the bushing and the thrust washer to create a hydrodynamic film between the bushing and the thrust washer when the drive shaft rotates.

10. The electric submersible pump of claim 9, wherein the drive shaft is oriented in the wellbore vertically.

11. The electric submersible pump of claim 9, wherein a first slot is formed in an outer circumferential surface of the bushing proximate to the axial face of the bushing, a second slot is formed in the outer circumferential surface of the bushing proximate to another axial face of the bushing, and wherein an anti-rotation tab is secured in a longitudinal slit in the outer circumferential surface of the bushing by a first retention ring disposed in the first slot and a second retention ring disposed in the second slot.

12. The electric submersible pump of claim 11, wherein the anti-rotation tab is inserted inside a slot in the stator.

13. The electric submersible pump of claim 9, wherein each of the concavities has an arc radius and a depth, and wherein the arc radius is greater than 5,000 times the depth.

14. The electric submersible pump of claim 9, wherein a hydrodynamic force against the bushing and the thrust washer is 5 to 5,000 N when the drive shaft rotates.

15. The electric submersible pump of claim 14, wherein the hydrodynamic force prevents contact between the bushing and the thrust washer when the drive shaft rotates.

16. The electric submersible pump of claim 9, wherein grooves are formed in the axial face of the bushing or the axial face of the thrust washer, and wherein the grooves are configured to guide lubrication fluid radially outward.

17. A rotor assembly for an electric submersible pump, comprising:

a drive shaft;

a journal sleeve concentrically disposed about and rotationally fixed to the drive shaft;

a bushing concentrically disposed about the journal sleeve; and a component encircling the drive shaft, wherein concavities are formed in an axial face of the bushing or an axial face of the component, wherein the axial face of the bushing is disposed proximate to the axial face of the component, and wherein the concavities are configured to influence flow of lubrication fluid between the bushing and the component to create a hydrodynamic force of 5 to 5,000 N against the bushing and the component when the drive shaft rotates.

18. The rotor assembly of claim 17, wherein grooves are formed in the axial face of the bushing or the axial face of the component, and wherein the grooves are configured to guide lubrication fluid radially outward.

19. The rotor assembly of claim 17, wherein the component is a rotor module configured to act as a thrust washer.

20. The rotor assembly of claim 17, wherein each of the concavities has an arc radius and a depth, and wherein the arc radius is greater than 5,000 times the depth.

21. The rotor assembly of claim 17, wherein the hydrodynamic force is 5 to 5,000 N.

22. The rotor assembly of claim 17, wherein grooves are formed in the concavities or between the concavities, and wherein the grooves extend deeper than the concavities.

23. The rotor assembly of claim 17, wherein the concavities comprise an arcuate profile or a chamfer.

* * * * *